US010579013B2

(12) United States Patent
Nieda

(10) Patent No.: US 10,579,013 B2
(45) Date of Patent: Mar. 3, 2020

(54) DRIVE TRANSMITTING DEVICE CONFIGURED TO REDUCE COST AND/OR NOISE, AND IMAGE FORMING APPARATUS INCORPORATING THE DRIVE TRANSMITTING DEVICE

(71) Applicant: Hiroaki Nieda, Kanagawa (JP)

(72) Inventor: Hiroaki Nieda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/229,753

(22) Filed: Dec. 21, 2018

(65) Prior Publication Data

US 2019/0243303 A1 Aug. 8, 2019

(30) Foreign Application Priority Data

Feb. 5, 2018 (JP) ..... 2018-018650

(51) Int. Cl.

| | |
|---|---|
| ***G03G 15/00*** | (2006.01) |
| ***G03G 21/18*** | (2006.01) |
| ***G03G 21/16*** | (2006.01) |
| *G03G 15/16* | (2006.01) |

(52) U.S. Cl.

CPC ..... *G03G 21/186* (2013.01); *G03G 15/757* (2013.01); *G03G 21/1647* (2013.01); *G03G 15/1615* (2013.01); *G03G 2221/1657* (2013.01)

(58) Field of Classification Search

USPC ..... 399/111

See application file for complete search history.

(56) References Cited

U.S. PATENT DOCUMENTS

| | | | |
|---|---|---|---|
| 2017/0168446 | A1 | 6/2017 | Nieda |
| 2017/0199490 | A1 | 7/2017 | Nieda |
| 2018/0329339 | A1 | 11/2018 | Nieda |

FOREIGN PATENT DOCUMENTS

| | | |
|---|---|---|
| JP | 2013-195961 | 9/2013 |
| JP | 2014-231905 | 12/2014 |
| JP | 2017-054080 | 3/2017 |
| JP | 2017-125896 | 7/2017 |

OTHER PUBLICATIONS

Computer Translation of JP2014-231905A to Hirose (Year: 2014).*

* cited by examiner

*Primary Examiner* — Quana Grainger
(74) *Attorney, Agent, or Firm* — Harness, Dickey & Pierce, P.L.C.

(57) ABSTRACT

A drive transmitting device, which is included in an image forming apparatus, includes a support, a first rotary body, a second rotary body, and a connector. The first rotary body is rotatably supported by the support and includes a support receiving portion with an opening disposed at a center of rotation of the first rotary body. The second rotary body has having an opening at a center of rotation of the second rotary body. The connector has one end inserted into the opening of the support receiving portion of the first rotary body and another end inserted into the opening of the second rotary body in an axial direction of the connector and connect the first rotary body and the second rotary body. The support is inserted into the opening of the support receiving portion of the first rotary body.

15 Claims, 24 Drawing Sheets

DRIVE TRANSMITTING DEVICE CONFIGURED TO REDUCE COST AND/OR NOISE, AND IMAGE FORMING APPARATUS INCORPORATING THE DRIVE TRANSMITTING DEVICE

CROSS-REFERENCE TO RELATED APPLICATION

This patent application is based on and claims priority pursuant to 35 U.S.C. § 119(a) to Japanese Patent Application No. 2018-018650, filed on Feb. 5, 2018, in the Japan Patent Office, the entire disclosure of which is hereby incorporated by reference herein.

BACKGROUND

Technical Field

This disclosure relates to a drive transmitting device and an image forming apparatus incorporating the drive transmitting device.

Related Art

Various kinds of drive transmitting devices are known to include a first rotary body that has an opening at the center of rotation and is rotatably supported by a supporting member, a second rotary body that has an opening at the center of rotation, and a connecting member that couples the first rotary body and the second rotary body while one end of the connecting member is inserted into the opening of the first rotary body and the other end of the connecting member is inserted into the opening of the second rotary body.

A known drive transmitting device includes a first rotary body having a tubular shape. The first rotary body has an opening into which a connecting member is inserted. A gear portion by which a driving force of a drive motor is transmitted is mounted at the center in the axial direction on an outer circumferential surface of the tubular first rotary body. The known drive transmitting device further includes a supporting member that is made of a resin material. The supporting member that supports the first rotary body has an opening. A side of the first rotary body opposite the side to which the connecting member is inserted via the gear portion is inserted into the opening of the supporting member, so that the first rotary body is supported by the supporting member.

However, when the first rotary body is supported by the supporting member in the known drive transmitting device, it was likely that the supporting member is welded when an excessive radial load is applied to the supporting member.

SUMMARY

At least one aspect of this disclosure provides a drive transmitting device including a support, a first rotary body, a second rotary body, and a connector. The first rotary body is rotatably supported by the support and including a support receiving portion with an opening disposed at a center of rotation of the first rotary body. The second rotary body has an opening at a center of rotation of the second rotary body. The connector has one end inserted into the opening of the support receiving portion of the first rotary body and another end inserted into the opening of the second rotary body in an axial direction of the connector. The connector connects the first rotary body and the second rotary body. The support is inserted into the opening of the support receiving portion of the first rotary body.

Further, at least one aspect of this disclosure provides an image forming apparatus including the above-described drive transmitting device configured to transmit a driving force from a drive source.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
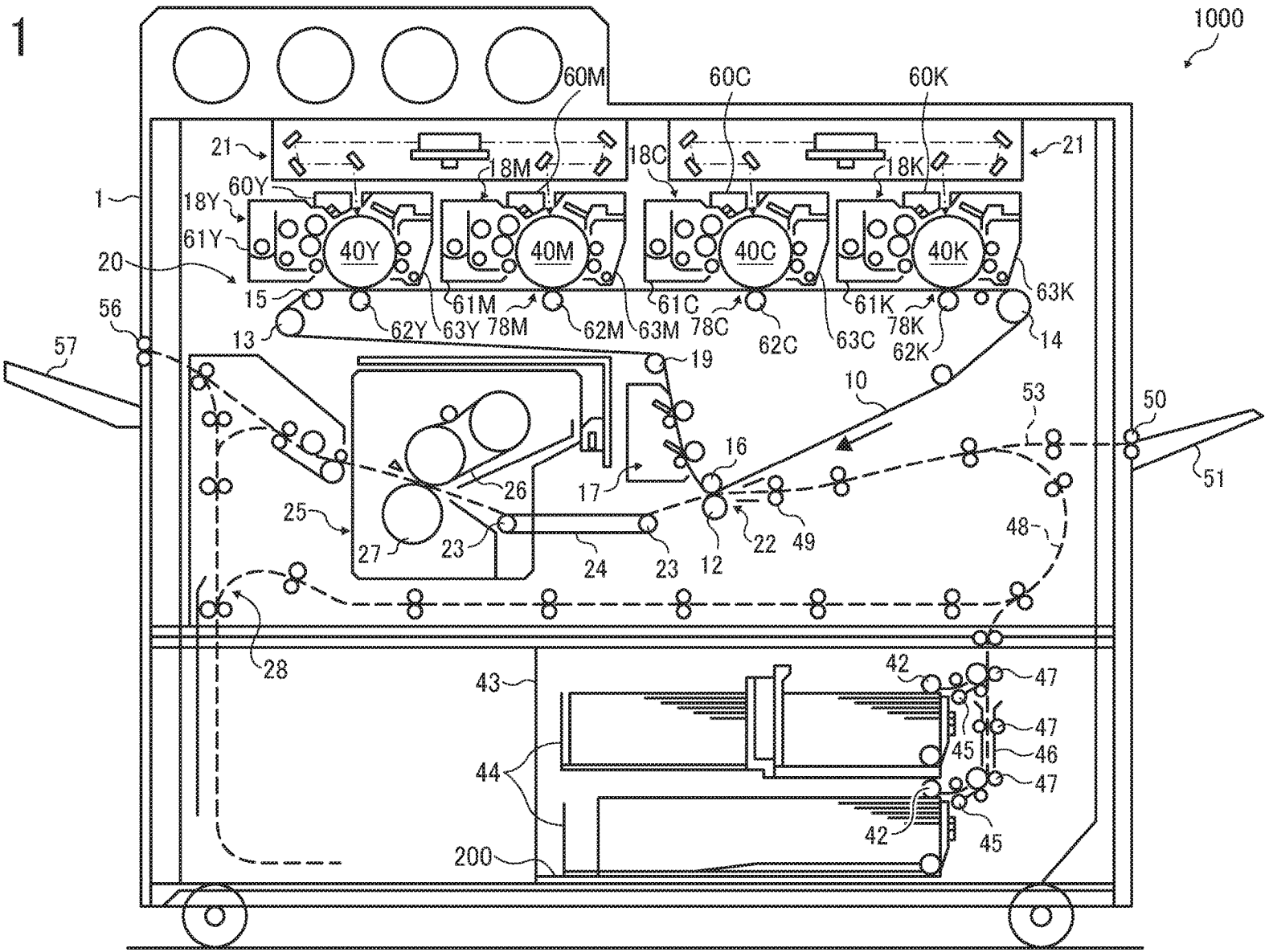
FIG. 1 is a diagram illustrating a schematic configuration of an example of an electrophotographic image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet conveying device and an image forming apparatus incorporating the sheet conveying device.

It is to be noted that elements (for example, mechanical parts and components) having the same functions and shapes are denoted by the same reference numerals throughout the specification and redundant descriptions are omitted.

Now, a description is given of an image forming apparatus according to an embodiment of this disclosure.

FIG. 1 is a diagram illustrating an example of a schematic configuration of an electrophotographic image forming apparatus 1000 according to an embodiment of this disclosure. Hereinafter, the electrophotographic image forming apparatus 1000 is simply referred to as the image forming apparatus 1000.

The image forming apparatus 1000 may be a copier, a facsimile machine, a printer, a multifunction peripheral or a multifunction printer (MFP) having at least one of copying, printing, scanning, facsimile, and plotter functions, or the like. According to the present example, the image forming apparatus 1000 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 1000 is a tandem intermediate transfer image forming apparatus and includes an apparatus body 1 and a sheet feeding table 200. The apparatus body 1 is mounted on the sheet feeding table 200 that functions as a sheet feeding device to contain and feed a sheet that functions as a recording medium. The suffixes Y, M, C, and K of the reference numerals in FIG. 1 indicate the respective colors of yellow, magenta, cyan, and black.

An intermediate transfer belt 10 that functions as an intermediate transfer body is disposed about the center of the apparatus body 1 of the image forming apparatus 1000. The intermediate transfer belt 10 is an image bearer having an endless belt and is wound around multiple support rollers 13, 14, 15, and 19 rotatably in a clockwise direction in FIG. 1.

In the image forming apparatus 1000 in FIG. 1, a belt cleaning device 17 that cleans the intermediate transfer belt 10 is disposed on the left side of a secondary transfer counter roller 16 that is one of the multiple support rollers provided in the apparatus body 1 of the image forming apparatus 1000. The belt cleaning device 17 removes residual toner remaining on the intermediate transfer belt 10 after an image formed on the intermediate transfer belt 10 is transferred.

The image forming apparatus 1000 further includes a tandem image forming device 20 that includes four image forming units 18Y, 18M, 18C, and 18K aligned along a belt moving direction of the intermediate transfer belt 10 that is stretched between the support roller 14 and the support roller 15.

As illustrated in FIG. 1, optical writing devices 21 are aligned above the tandem image forming device 20. The image forming units 18Y, 18M, 18C, and 18K of the tandem image forming device 20 also include photoconductor drums 40Y, 40M, 40C, and 40K that function as image bearers to form respective latent images of yellow, magenta, cyan, and black, respectively. Each of the image forming units 18Y, 18M, 18C, and 18K includes a corresponding one of the photoconductor drums 40Y, 40M, 40C, and 40K and respective image forming components disposed around each of the photoconductor drums 40Y, 40M, 40C, and 40K as a single unit supported by a common support. Each of the image forming units 18Y, 18M, 18C, and 18K of the tandem image forming device 20 is detachably attached as a single unit to the apparatus body 1 of the image forming apparatus 1000. The image forming units 18Y, 18M, 18C, and 18K have respective configurations identical to each other except the colors of toners, and therefore are occasionally described without suffixes indicating the toner colors, which are Y, M, C, and K.

The image forming unit 18 (i.e., the image forming units 18Y, 18M, 18C, and 18K) includes the photoconductor drum 40 (i.e., the photoconductor drums 40Y, 40M, 40C, and 40K) and a developing device 61 (i.e., developing devices 61Y, 61M, 61C, and 61K) that develops an electrostatic latent image formed on a surface of the photoconductor drum 40 into a visible toner image.

The image forming unit 18 (i.e., the image forming units 18Y, 18M, 18C, and 18K) further includes a charging device 60 (i.e., charging devices 60Y, 60M, 60C, and 60K) and a drum cleaning device 63 (i.e., drum cleaning devices 63Y, 63M, 63C, and 63K). The charging device 60 uniformly charges the surface of the photoconductor drum 40 (i.e., the photoconductor drums 40Y, 40M, 40C, and 40K) while the photoconductor drum 40 is rotating. The drum cleaning device 63 removes transfer residual toner remaining on the surface of the photoconductor drum 40 after passing a primary transfer nip region and cleans the surface of the photoconductor drum 40.

The surfaces of the photoconductor drums 40Y, 40M, 40C, and 40K are uniformly charged by the charging devices 60Y, 60M, 60C, and 60K, respectively, and are then exposed by the optical writing devices 21 based on the image data. As a result, latent images are formed on the surfaces of the photoconductor drums 40Y, 40M, 40C, and 40K.

The latent image formed on the photoconductor drum 40 (i.e., the photoconductor drums 40Y, 40M, 40C, and 40K) is developed to a visible toner image by the developing device 61 (i.e., the developing devices 61Y, 61M, 61C, and 61K), so that the visible toner image is borne on the surface of the photoconductor drum 40. A primary transfer roller 62 (i.e., primary transfer rollers 62Y, 62M, 62C, and 62K) is disposed at a primary transfer position where the toner image is transferred from the photoconductor drum 40 onto the intermediate transfer belt 10. The support roller 14 is a drive roller that rotationally drives the intermediate transfer belt 10. When forming a black image on the intermediate transfer belt 10, the support rollers 13 and 15 other than the support roller 14 are moved to separate the photoconductor drums 40Y (for yellow toner), 40M (for magenta toner), and 40C (for cyan toner) from the intermediate transfer belt 10.

The photoconductor drums 40Y, 40M, 40C, and 40K have residual toner remaining on the surfaces after the respective toner images are transferred onto the intermediate transfer belt 10. The drum cleaning device 63 removes the residual toner form the surface of the photoconductor drums 40Y, 40M, 40C, and 40K to clean the photoconductor drums 40Y, 40M, 40C, and 40K for subsequent image formation.

The apparatus body 1 of the image forming apparatus 1000 further includes a secondary transfer device 22 at an opposite side of the tandem image forming device 20 with the intermediate transfer belt 10 interposed between the secondary transfer device 22 and the tandem image forming device 20. In the secondary transfer device 22 of the image forming apparatus 1000 illustrated in FIG. 1, a secondary transfer roller 12 is pressed against the secondary transfer counter roller 16 to apply a transfer electric field to the secondary transfer roller 12 and the secondary transfer counter roller 16. By so doing, the image formed on the intermediate transfer belt 10 is transferred onto a sheet.

The image forming apparatus 1000 further includes a fixing device 25 next to the secondary transfer device 22. The fixing device 25 fixes an unfixed toner image transferred and formed on the sheet to the sheet. The fixing device 25 includes a fixing belt 26 and a pressure roller 27. The fixing belt 26 is an endless belt that functions as a sheet conveying body and is pressed against the pressure roller 27 that functions as a pressing body. The image forming apparatus 1000 further includes a conveying belt 24 that is wound around support rollers 23. The conveying belt 24 is rotationally driven to convey the sheet on which the image is formed, to the fixing device 25.

It is to be noted that the image forming apparatus 1000 illustrated in FIG. 1 further includes a sheet reversing device 28 below the secondary transfer device 22 and the fixing device 25 and parallel to the tandem image forming device 20. The sheet reversing device 28 reverses the sheet when performing duplex printing to form respective images on both sides of the sheet.

In the image forming apparatus 1000 having the above-described configuration, when image data is sent to the apparatus body 1 of the image forming apparatus 1000 and the image forming apparatus 1000 receives a signal to start an image forming operation, the drive motor drives and rotates the support roller 14 to cause the other support rollers 13, 15, and 23 to rotate with the support roller 14. By so doing, the intermediate transfer belt 10 is rotated. At the same time, respective single color images of yellow, magenta, cyan, and black toners are formed on the photoconductor drums 40Y, 40M, 40C, and 40K by the image forming units 18Y, 18M, 18C, and 18K, respectively. Along with endless movement of the intermediate transfer belt 10, the respective single color images of yellow, magenta, cyan, and black toners are conveyed to the primary transfer positions, that is, respective primary transfer nip regions formed between the photoconductor drums 40Y, 40M, 40C, and 40K and the primary transfer rollers 62Y, 62M, 62C, and 62K, respectively. In the respective transfer nip regions, the respective single color toner images are sequentially transferred onto the surface of the intermediate transfer belt 10 to form a composite color toner image on the surface of the intermediate transfer belt 10.

The image forming apparatus 1000 further includes multiple sheet teed trays 44 provided to a sheet bank 43 in the sheet feeding table 200. Each of the multiple sheet feed trays 44 has a sheet feed roller 42. A selected sheet feed roller 42 rotates to feed the sheet from a corresponding one of the sheet feed trays 44 having the selected sheet feed roller 42, and a sheet separation roller 45 separates sheets one by one and conveys a separated sheet to a sheet conveyance passage 46. Then, the sheet is conveyed by a sheet conveying roller 47 to a sheet conveyance passage 48 in the apparatus body 1 of the image forming apparatus 1000. The sheet is brought to contact a pair of registration rollers 49 to stop.

Alternatively, a bypass sheet feed roller 50 rotates to feed a sheet placed on a bypass tray 51. The fed sheet is separated by a bypass separation roller one by one to be conveyed to a bypass sheet feed passage 53 until the sheet contacts the pair of registration rollers 49 to stop temporarily. The pair of registration rollers 49 is rotated in synchronization with movement of the composite color toner image formed on the intermediate transfer belt 10, and the sheet is conveyed between the intermediate transfer belt 10 and the secondary transfer roller 12 of the secondary transfer device 22. Then, the composite color toner image on the intermediate transfer belt 10 is transferred onto the sheet in the secondary transfer device 22 to form a color image on the sheet. The sheet having the image thereon after image transfer is conveyed by the secondary transfer device 22 to the fixing device 25. In the fixing device 25, the image is fixed to the sheet by application of heat and pressure. Then, the sheet is output by a pair of sheet output rollers 56 onto a sheet discharging tray 57. In the duplex printing, a switching claw moves to switch a direction of passage of the sheet to the sheet reversing device 28 where the sheet is reversed and guided to the secondary transfer position again. Thereafter, a color toner image is formed on the back face of the sheet and is discharged by the pair of sheet output rollers 56 to the sheet discharging tray 57.

The intermediate transfer belt 10 has residual toner remaining on the surface after the image transfer. The belt cleaning device 17 removes the residual toner form the surface of the intermediate transfer belt 10 to clean the intermediate transfer belt 10 for subsequent image formation by the tandem image forming device 20.

In the image forming apparatus 1000 having the above-described configuration, a front cover is disposed on the front side of the apparatus body 1 (i.e., the near side in the drawing sheet of FIG. 1). The front cover is rotatable with respect to the apparatus body 1 by a support shaft and attached openably and closably. Then, the front cover is rotated about the support shaft to open relative to the apparatus body 1. By so doing, the photoconductor drum 40, the charging device 60, the developing device 61, and the drum cleaning device 63 disposed in the apparatus body 1 of the image forming apparatus 1000 are attached to and detached from the apparatus body 1 as one unit. When any one of the photoconductor drum 40, the charging device 60, the developing device 61, and the drum cleaning device 63 has reached the service life, the whole unit is removed to be replaced to a new unit. Therefore, the drive transmitting device 70 that transmits a drive force from a drive motor that functions as a drive source of the image forming apparatus 1000 to a rotary body of a drive transmission target such as the photoconductor drum 40 includes a drive connecting member 90 that connects and disconnects the drive motor and the rotary body.

Figure 2:
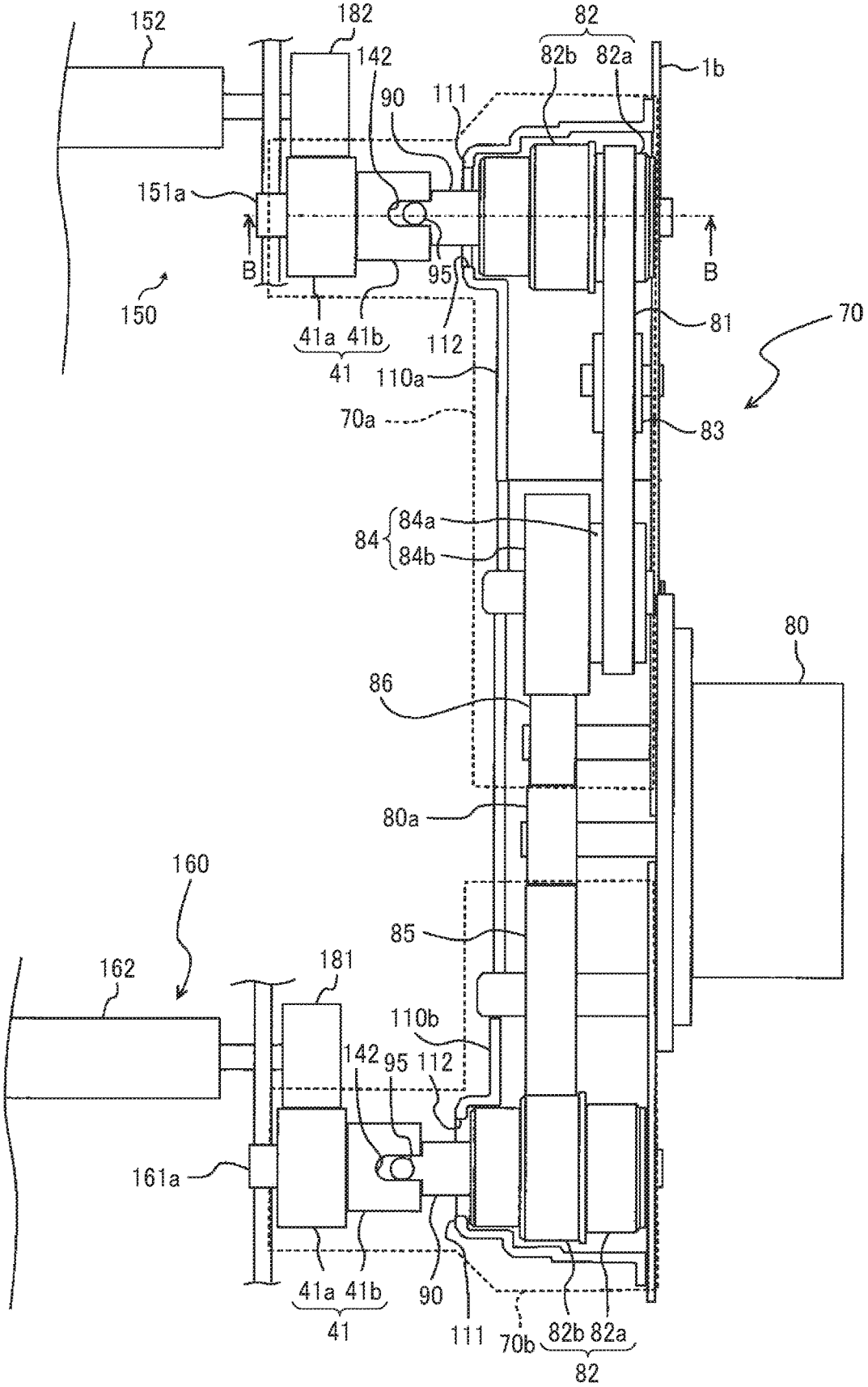
FIG. 2 is a diagram illustrating a schematic configuration of a drive transmitting device.

FIG. 2 is a diagram illustrating schematic configuration of the drive transmitting device 70 according to an embodiment of this disclosure.

As illustrated in FIG. 2, the drive transmitting device 70 includes a first drive transmitting portion 70*a* and a second drive transmitting portion 70*b*. The first drive transmitting portion 70*a* transmits a driving force applied by a drive motor 80 to a first roller 152 of a first unit 150. The second drive transmitting portion 70*b* transmits a driving force applied by the drive motor 80 to a second roller 162 of a second unit 160.

The first drive transmitting portion 70*a* includes a first idler gear 86, a first drive input member 84, a timing belt 81, a tightener 83, a drive side coupling member 82 that functions as a first rotary body, the drive connecting member 90, and a driven side coupling member 41 that functions as a second rotary body. The first idler gear 86 is meshed with a motor gear 80*a* of the drive motor 80 that functions as a drive source. The first drive input member 84 includes a drive pulley 84*a* and an input gear 84*b* that meshes with the first idler gear 86.

The drive side coupling member 82 includes a pulley 82*a* and a gear 82*b*. The timing belt 81 that functions as a drive transmitting body is wound around the drive pulley 84*a* of the first drive input member 84 and the pulley 82*a* of the drive side coupling member 82. The tightener 83 contacts the front face of the timing belt 81 to tension the timing belt 81.

One end of the drive connecting member 90 that functions as a connector is inserted into the drive side coupling member 82 and the other end of the drive connecting member 90 is inserted into the driven side coupling member 41, so that the drive side coupling member 82 and the driven side coupling member 41 are coupled to each other. The driven side coupling member 41 of the first unit 150 is rotatably mounted on a first stud 151*a* of the first unit 150.

The driven side coupling member 41 includes a gear 41*a* and a coupling portion 41*b*. The other end of the drive connecting member 90 is inserted into the coupling portion 41*b* of the driven side coupling member 41. The gear 41*a* meshes with an output gear 182 that is mounted on a roller shaft of the first roller 152.

The second drive transmission portion 70*b* has a configuration that is basically identical to the first drive transmitting portion 70*a*, except that the second drive transmitting portion 70*b* transmits a driving force from the motor gear 80*a* to the drive side coupling member 82 with a second idler gear 85 that meshes with the motor gear 80*a* of the drive motor 80 and the gear 82*b* of the drive side coupling member 82 while the first drive transmitting portion 70*a* transmits a driving force from the motor gear 80*a* to the drive side coupling member 82 with the timing belt 81.

The driven side coupling member 41 of the second unit 160 is rotatably mounted on a second stud 161*a* of the second unit 160. The other end of the drive connecting member 90 is inserted into the coupling portion 41*b* of the driven side coupling member 41. An output gear 181 that is mounted on a roller shaft of a second roller 162 is meshed with the gear 41*a* of the driven side coupling member 41.

In the present embodiment, the drive side coupling member 82 includes the pulley 82*a* that functions as a tensioning portion and the gear 82*b*. According to this configuration, the first drive transmitting portion 70*a* and the second drive transmitting portion 70*b* can use the respective drive side coupling members having the configurations identical to each other. Accordingly, parts control cost can be reduced, and a device cost can be reduced. For example, the developing device 61Y may be the first unit 150 and the developing device 61M may be the second unit 160. In this case, the first roller 152 and the second roller 162 may transmit respective driving forces to respective developing rollers and respective developer conveyance screws that convey developer in the developing devices, for example, the developing devices 61Y and 61M, respectively.

In addition, the drive transmitting device 70 includes a first cover 110*a* and a second cover 110*b*, both of which cover the drive transmission members provided on the side of the side plate 1*b*. Specifically, the first cover 110*a* covers the tightener 83 and the drive side coupling member 82 of the first drive transmitting portion 70*a*, and the second cover 110*b* covers the first drive input member 84, the first idler gear 86, the second idler gear 85, and the drive side coupling member 82 of the second drive transmitting portion 70*b*. Each of the first cover 110*a* and the second cover 110*b* has a through hole into which the drive connecting member 90 is inserted. A retaining portion 111 is formed around the through hole of each of the first cover 110*a* and the second cover 110*b*. The retaining portion 111 is disposed facing the drive side coupling member 82 in the axial direction to prevent the drive side coupling member 82 from coming out from a metal stud 100 (see FIG. 3) that rotatably supports the drive side coupling member 82.

Figure 3:
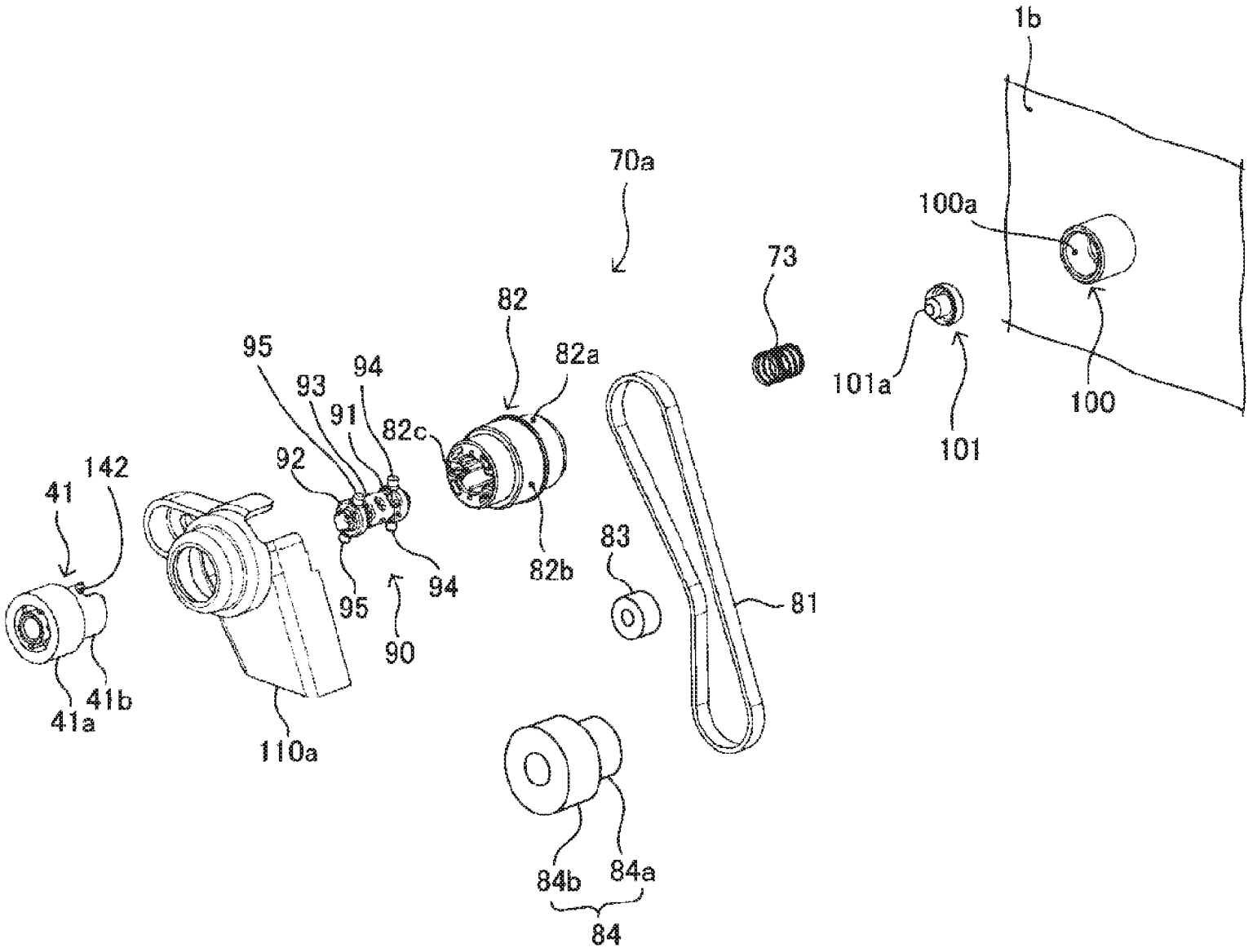
FIG. 3 is an exploded perspective view illustrating a first drive transmitting portion of the drive transmitting device of FIG. 3.
Figure 4:
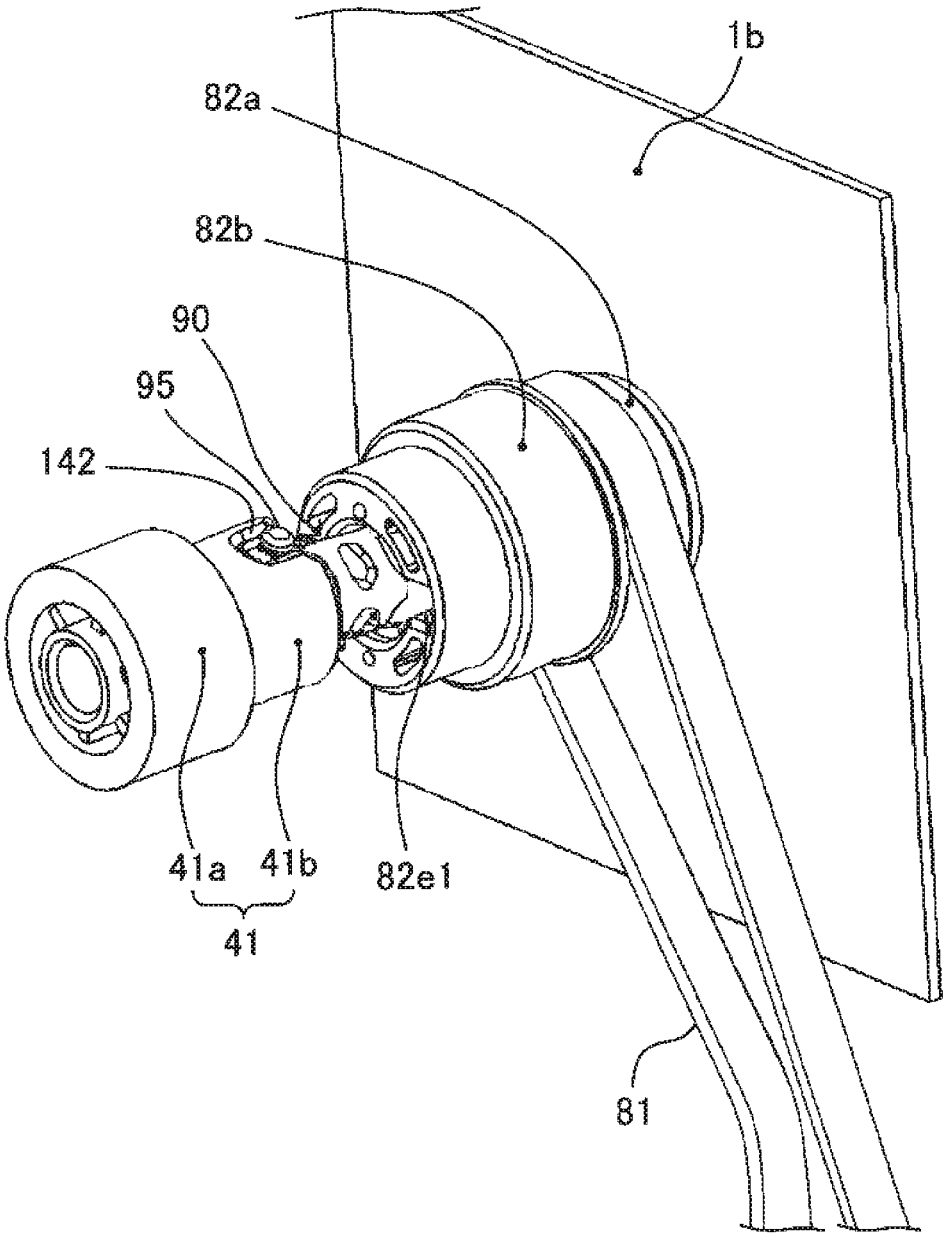
FIG. 4 is a perspective view illustrating a main part of the first drive transmitting portion.
Figure 5:
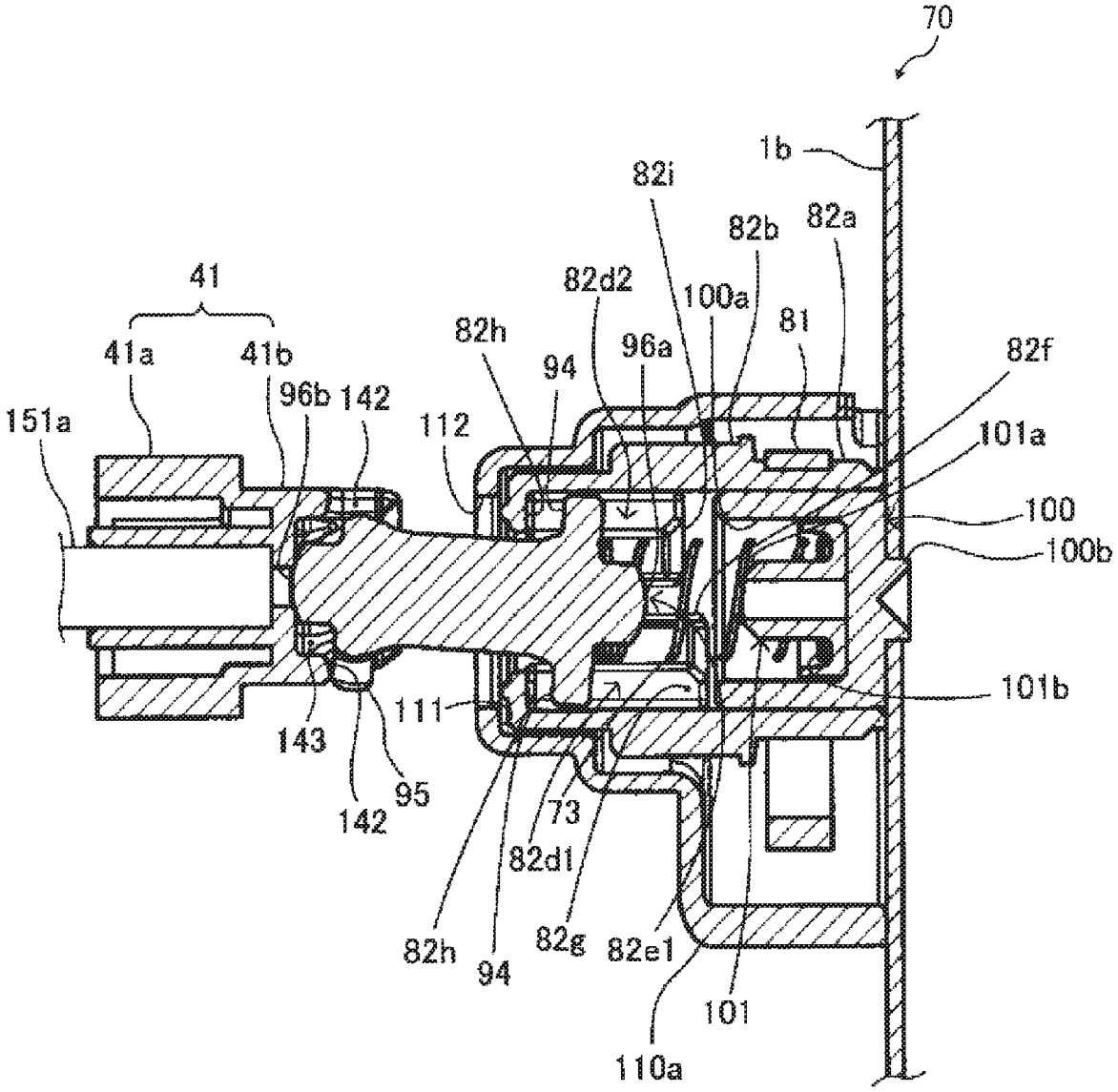
FIG. 5 is a cross sectional view illustrating the drive transmitting device of FIG. 2, along a line B-B of FIG. 2.

FIG. 3 is an exploded perspective view illustrating the first drive transmitting portion 70*a*. FIG. 4 is a perspective view illustrating a main part of the first drive transmitting portion 70*a*. FIG. 5 is a cross sectional view illustrating the drive transmitting device 70, along a line B-B of FIG. 2.

The metal stud 100 is fixedly placed by caulking on the side plate 1*b* to which the drive motor 80 is attached. The metal stud 100 functions as a support to rotatably support the drive side coupling member 82. The metal stud 100 has a cylindrical shape and has a spring storing portion 100*a* in which a spring holder 101 and a coil spring 73 are stored. The spring storing portion 100*a* that functions as a storing portion is made of a conductive resin material. In addition, the drive side coupling member 82 is made of a resin material and has an opening 82*c* at the center of rotation. The metal stud 100 is inserted into the opening 82*c* that functions as a support receiving portion, so that the drive side coupling member 82 is rotatably supported by the metal stud 100 (see FIG. 5).

As illustrated in FIG. 5, the metal stud 100 is inserted into the drive side coupling member 82 to or beyond a portion where the pulley 82*a* of the drive side coupling member 82 is formed in the axial direction, so that the metal stud 100 supports the portion where the pulley 82*a* of the drive side coupling member 82 is formed.

By supporting the opening 82*c* of the drive side coupling member 82 in the present embodiment, the metal stud 100 functions as a support to support the drive side coupling member 82. As described above, since the metal stud 100 functions as a support that supports the drive side coupling member 82, even when the support receives an excessive radial weight by a tension force of the timing belt 81 applied to the pulley 82*a*, the support is not welded.

In a case in which the drive side coupling member 82 is inserted into a support having a cylindrical shape mounted on the side plate 1*b* and is supported by an inner circumferential surface of the support, the support manages to support the drive side coupling member 82 up to a range before the pulley 82*a* that is formed around the outer circumferential surface of the drive side coupling member 82. As a result, it is likely that the drive side coupling member 82 becomes inclined with a fulcrum at a position of the support due to a tension force of the timing belt 81 that is applied to the pulley 82*a*.

By contrast, in the present embodiment, the metal stud 100 supports the drive side coupling member 82 to a range including the pulley 82*a* of the drive side coupling member 82 is formed. Accordingly, the metal stud 100 preferably receives the tension force of the timing belt 81 that is applied to the pulley 82*a*, and therefore restrains the drive side coupling member 82 from being inclined by the tension force of the timing belt 81.

In addition, since the pulley 82*a* is provided closer to the side plate 1*b* on which the metal stud 100 is mounted than the gear 82*b* is, when compared with a configuration in which the gear 82*b* is disposed closer to the side plate 1*b* than the pulley 82*a*, the metal stud 100 having a shorter axial length can support the drive side coupling member 82 to the portion where the pulley 82*a* is formed. Further, by providing the pulley 82*a* closer to the side plate 1*b* than the gear 82*b*, a spherical shape portion of the drive connecting member 90 is placed at a portion where the gear 82*b* is formed. Accordingly, this configuration restrains the drive side coupling member 82 from increasing in size in the axial direction.

In the present embodiment, the metal stud 100 is formed in a cylindrical shape and contains the spring holder 101 that functions as a resin receiver and the coil spring 73 that functions as a biasing body. Accordingly, the drive side coupling member 82 can achieve a reduction in size in the axial direction.

The drive side coupling member 82 is a resin molding product made of polyacetal resin (POM) and includes the opening 82*c* into which one of a first spherical portion 91 and a second spherical portion 92 of the drive connecting member 90 is inserted. The drive connecting member 90 is movable in the axial direction and assembled to the drive side coupling member 82 with an angle or tiltable relative to the axial direction.

Figure 6A:
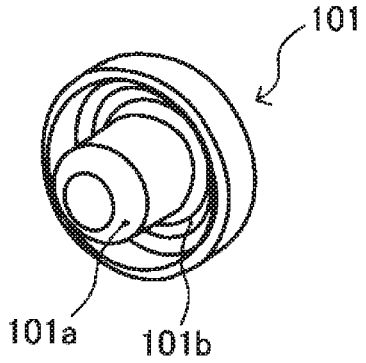
FIGS. 6A, 6B, and 6C are schematic views illustrating a spring holder.
Figure 6B:
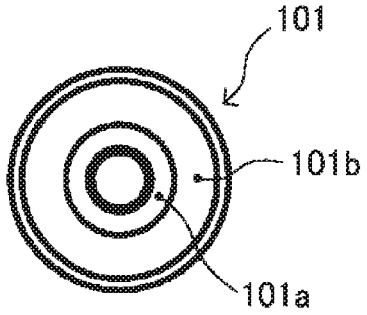
Figure 6C:
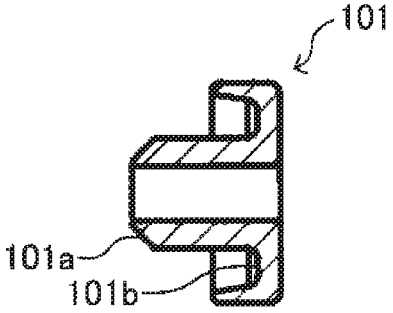

FIGS. 6A, 6B, and 6C are diagrams illustrating the spring holder 101. Specifically, FIG. 6A is a perspective view illustrating the spring holder 101, FIG. 6B is a front view illustrating the spring holder 101, and FIG. 6C is a cross sectional view illustrating the spring holder 101.

The spring holder 101 that is stored in the metal stud 100 includes a regulator 101*a* and a receiver 101*b*. The regulator 101*a* restricts movement of the drive connecting member 90 toward the side plate 1*b*. The receiver 101*b* receives one end of the coil spring 73. As illustrated in FIG. 5, the regulator 101*a* is inserted into the coil spring 73. One end of the coil spring 73 is in contact with the receiver 101*b*. A first spring holder 96*a* that is provided at one end the drive connecting member 90 is inserted into the coil spring 73. The other end of the coil spring 73 is in contact with the one end of the drive connecting member 90 to bias the drive connecting member 90 toward the unit.

As the other end of the coil spring 73 is in contact with the drive connecting member 90, the coil spring 73 is rotated with the drive connecting member 90 during drive transmission. When the metal stud 100 directly receives the one end of the coil spring 73, the coil spring 73 slides on the surface of the metal stud 100 during drive transmission. Since both the coil spring 73 and the metal stud 100 are made of metal, when the coil spring 73 slides on the metal stud 100, it is likely that abnormal noise occurs.

By contrast, in the present embodiment, the one end of the coil spring 73 contacts the spring holder 101 that is made of resin material. Therefore, the one end of the coil spring 73 made of metal slides on the spring holder 101 made of resin. Accordingly, occurrence of abnormal noise is restrained. In addition, by employing a resin material having good slidability such as polyacetal resin (POM) as the resin material of the spring holder 101, occurrence of abnormal noise can be more restrained.

Further, in the present embodiment, the spring holder 101 is made of conductive resin material. As described above, by providing the spring holder 101 made of conductive resin material, the drive connecting member 90 is electrically connected to the side plate 1*b* that is connected to a ground terminal, via the coil spring 73, the spring holder 101, and the metal stud 100. Accordingly, the drive connecting member 90 is electrically grounded, so that static electricity generated by sliding with the drive side coupling member 82 or the driven side coupling member 41 is electrically discharged to the ground via the drive connecting member 90, the coil spring 73, the spring holder 101, the metal stud 100, and the side plate 1*b*. Consequently, accumulation of static electricity on the drive connecting member 90 can be prevented. It is to be noted that the spring holder 101 may be any conductivity as long as static electricity is leaked. If the electrical resistivity is 10 K(ohm)(dot)cm or less, static electricity can be leaked. Therefore, the conductive resin in the present embodiment is defined to have the electrical resistivity of 10 K(ohm)(dot)cm or less.

Further, as illustrated in FIG. 5, two drive side grooves 82*d*1 and 82*d*2 are provided on the inner circumferential surface of the opening 82*c* of the drive side coupling member 82 in the rotation direction of the drive side coupling member 82 at intervals of an angle of 180 degrees. The first projections 94 of the drive connecting member 90 are inserted into the drive side grooves 82*d*1 and 82*d*2. Further, the respective unit side ends of the drive side grooves 82*d*1 and 82*d*2 (i.e., the left side of FIG. 5) are closed and provided with retaining portions 82*h* to prevent the first projections 94 in the drive side grooves 82*d*1 and 82*d*2 from coming off from the drive side grooves 82*d*1 and 82*d*2. Accordingly, when the drive connecting member 90 is about to come out from the coupling side ends of the opening 82*c*, the first projections 94 contact the retaining portions 82*h*. Accordingly, the configuration of the present embodiment can prevent the drive connecting member 90 from coming out from the unit side end of the opening 82*c*.

It is to be noted that the drive side grooves 82*d*1 and 82*d*2 are occasionally referred to as the drive side groove 82*d* when either one of the drive side grooves 82*d*1 and 82*d*2 is applicable.

Further, two guide grooves 82*e*1 and 82*e*2 are provided on the inner circumferential surface of the opening 82*c* of the drive side coupling member 82 in the rotation direction of the drive side coupling member 82 at intervals of an angle of 180 degrees. The first projections 94 of the drive connecting member 90 are guided to the opening 82*c* by the guide grooves 82*e*1 and 82*e*2 when the drive connecting member 90 is assembled to the drive side coupling member 82, as described below. The guide grooves 82*e*1 and 82*e*2 are provided at respective positions shifted by an angle of 90 degrees in the rotation direction with respect to the drive side groove 82*d* (i.e., the drive side grooves 82*d*1 and 82*d*2).

It is to be noted that the guide grooves 82*e*1 and 82*e*2 are occasionally referred to as the guide groove 82*e* when either one of the guide grooves 82*e*1 and 82*e*2 is applicable.

Further, one side face of the guide groove 82*e*1 is extended closer to the side plate 1*b* (i.e., in the right side direction in FIG. 5) than the other side face of the guide groove 82*e*1 is. The one side face of the guide groove 82*e*1 forms a regulator 82*f* that restricts the rotation direction of the drive connecting member 90 when the drive connecting member 90 is assembled, as described below. Similarly, one side face of the drive side groove 82*d*1 is also extended closer to the side plate 1*b* (i.e., in the right side direction in FIG. 5) than the other side face of the drive side groove 82*d*1 is. The one side face of the drive side groove 82*d*1 forms a regulator 82*g* that restricts the rotation direction of the drive connecting member 90.

In the present embodiment, when the drive connecting member 90 is not connected to the driven side coupling member 41, the first projections 94 is in contact with the retaining portions 82*h* due to the biasing force of the coil spring 73. According to this configuration, when the drive connecting member 90 and the driven side coupling member 41 are disconnected from each other, the drive connecting member 90 is supported by the drive side coupling member 82 in a straight attitude without being inclined with respect to the axial direction. However, when either one or both of the first projections 94 contact the retaining portions 82*h*, the drive side coupling member 82 is pressed toward the unit side, and therefore it is likely that the drive side coupling member 82 comes out from the metal stud 100. Therefore, in the present embodiment, a retaining portion 112 is provided to each of the first cover 110*a* and the second cover 110*b* to prevent the drive side coupling member 82 from coming out from the metal stud 100.

The driven side coupling member 41 is rotatably attached to the first stud 151*a* that is fixed to the side plate of the first unit 150. The coupling portion 41*b* of the driven side coupling member 41 has a driven side opening 143 into which the second spherical portion 92 of the drive connecting member 90 is inserted. The coupling portion 41*b* of the driven side coupling member 41 has a cylindrical shape. The coupling portion 41*b* is provided with two driven side grooves 142 disposed in the rotation direction of the driven side coupling member 41 at intervals of an angle of 180 degrees. The driven side grooves 142 are cut portions into which the second projections 95 of the drive connecting member 90 are inserted. The second spherical portion 92 of the drive connecting member 90 is inserted into the coupling portion 41*b* of the driven side coupling member 41.

Figure 7:
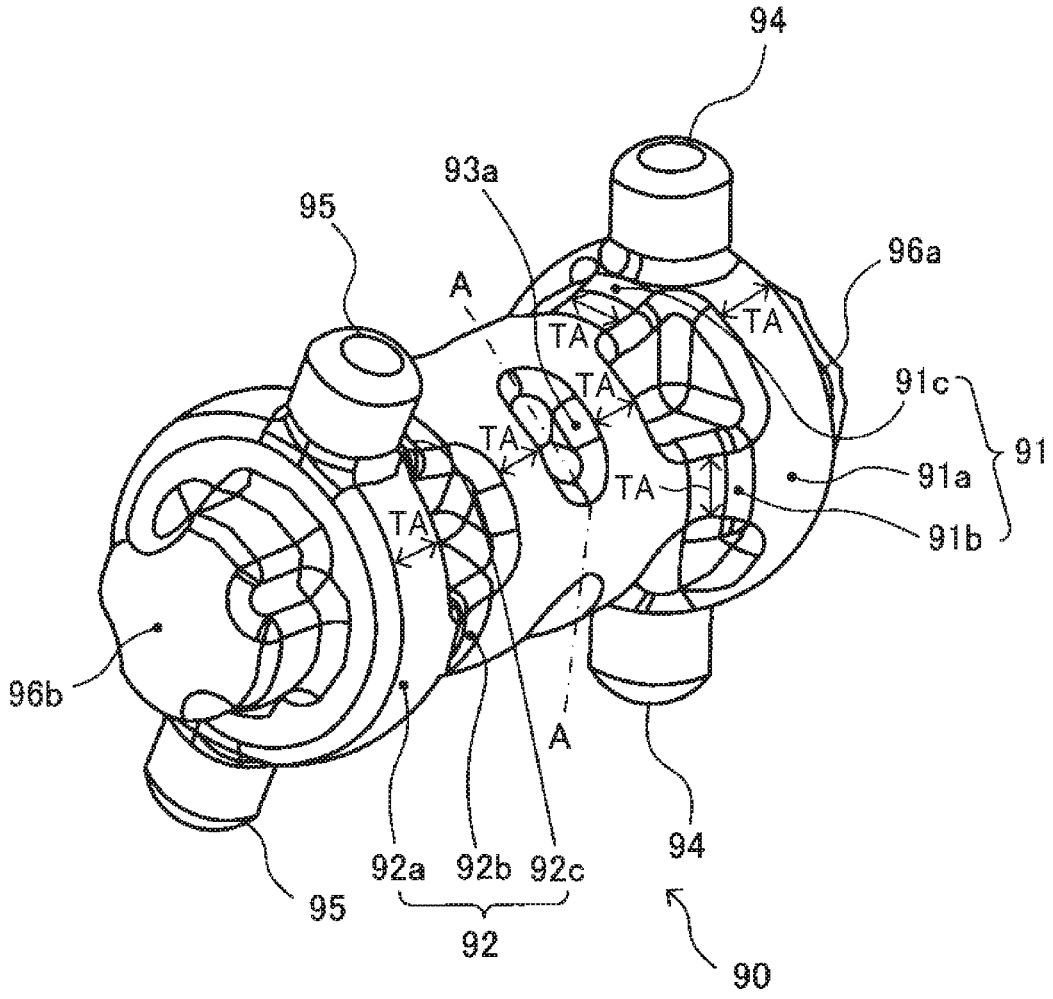
FIG. 7 is a perspective view illustrating a drive connecting member.
Figure 8A:
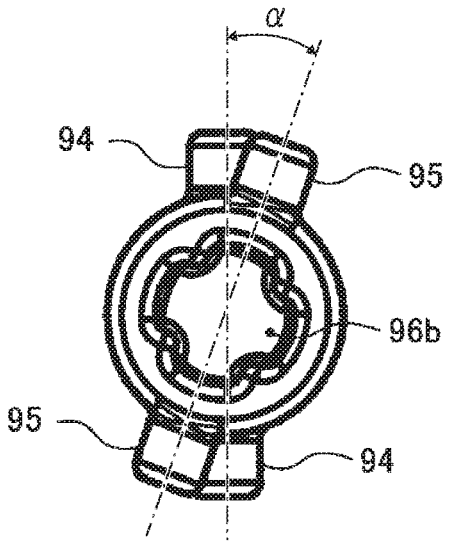
FIG. 8A is a front view illustrating the drive connecting member.
Figure 8B:
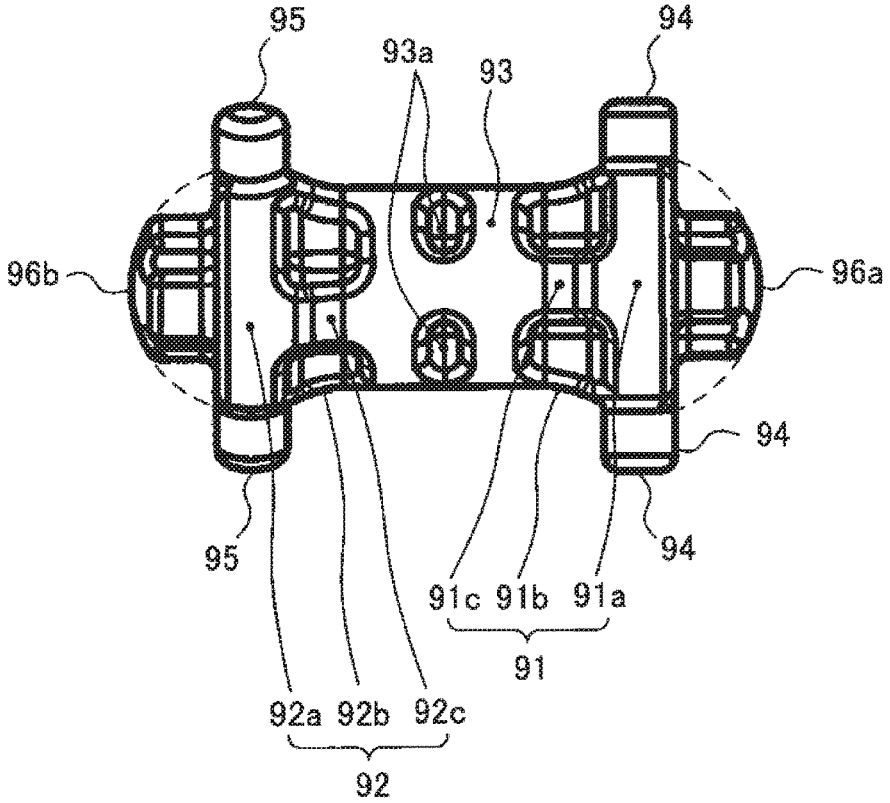
FIG. 8B is a side view illustrating the drive connecting member.
Figure 9:
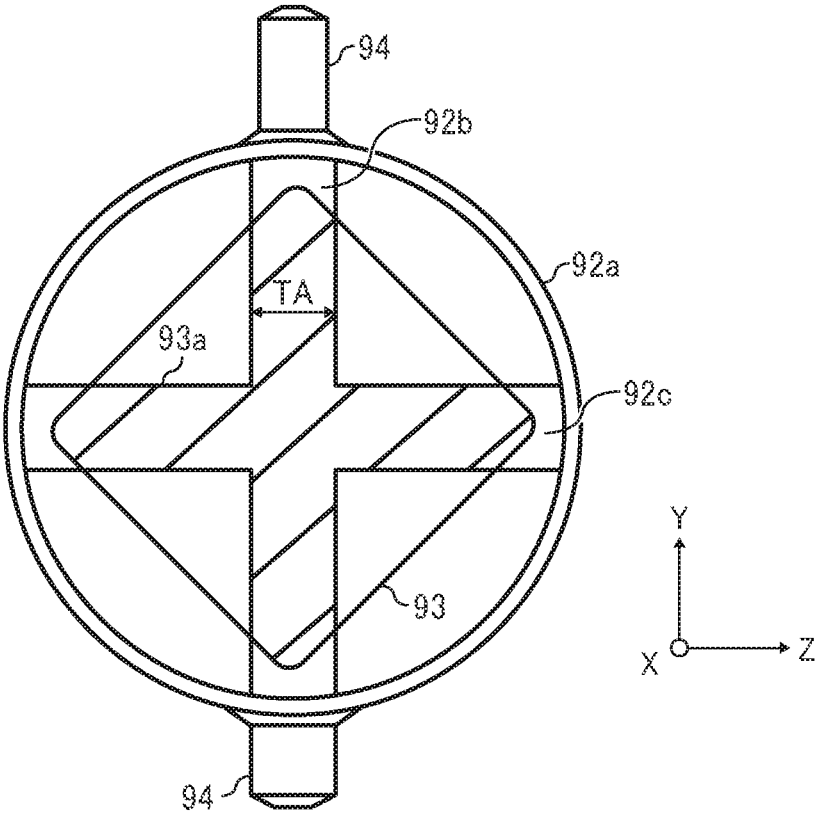
FIG. 9 is a cross sectional view illustrating the drive connecting member of FIG. 7, along a line A-A of FIG. 7.

FIG. 7 is a perspective view of the drive connecting member 90. FIG. 8A is a front view illustrating the drive connecting member 90. FIG. 8B is a side view illustrating the drive connecting member 90. FIG. 9 is a cross sectional view illustrating the drive connecting member 90 of FIG. 7, along a line A-A of FIG. 7.

The drive connecting member 90 is a resin molded product and includes the first spherical portion 91 as a first insertion portion, the second spherical portion 92 as a second insertion portion, a connecting portion 93 connecting the first spherical portion 91 and the second spherical portion 92. The first spherical portion 91 is provided with the first projections 94 and the first spring holder 96*a* that functions as a spring receiving portion. The second spherical portion 92 is provided with the second projections 95 and a second spring holder 96*b* that functions as a spring receiving portion. As the resin used for formation of the drive connecting member 90, a polyacetal resin (POM) having excellent mechanical strength and favorable wear resistance and slidability may be preferably used.

The first projections 94 have a columnar shape extending from the surface of the first spherical portion 91 in the normal direction (the direction orthogonal to the axial direction) and are provided at intervals of an angle of 180 degrees in the rotation direction. The second projections 95 have a columnar shape extending from the surface of the second spherical portion 92 in the normal direction (the direction orthogonal to the axial direction) and are provided at intervals of an angle of 180 degrees in the rotation direction. As illustrated in FIG. 8A, the second projections 95 are provided at respective positions displaced from the first projections 94 by an angle $\alpha$ in the rotation direction of the drive connecting member 90. In other words, the second projections 95 are disposed at different positions from the first projections 94 by the angle $\alpha$ in the rotation direction of the drive connecting member 90.

The first spherical portion 91 has a hemisphere shape that is lightened, leaving a first drive side large circle 91*a* that is a spherical large circle extending perpendicular to the axial direction, a second drive side large circle 91*b* that is a spherical large circle perpendicular to an extending direction of the first projections 94, and a third drive side large circle 91*c* that is a spherical large circle perpendicular to both the first drive side large circle 91*a* and the second drive side large circle 91*b*. It is to be noted that the large circle refers to a circle made such that a plane, which passes through the center of a sphere, intersects with a spherical surface.

The second spherical portion 92 has a hemisphere shape that is lightened, leaving a first driven side large circle 92*a* that is a spherical large circle extending perpendicular to the axial direction, a second driven side large circle 92*b* that is a spherical large circle perpendicular to an extending direction of the second projections 95, and a third driven side large circle 92*c* that is a spherical large circle perpendicular to both the first driven side large circle 92*a* and the second driven side large circle 92*b*.

In the present embodiment, the first spherical portion 91 and the second spherical portion 92 are formed to have a hemispherical shape that is lightened. However, the shape may be appropriately determined according to a maximum inclination angle of the drive connecting member 90. Further, the first spring holder 96*a* is provided at the center of rotation of the first spherical portion 91 and the second spring holder 96*b* is provided at the center of rotation of the second spherical portion 92. The top surface of the first spring holder 96*a* is a spherical surface having the same diameter as the diameter of the first spherical portion 91. The top surface of the second spring holder 96*b* is a spherical surface having the same diameter as the diameter of the second spherical portion 92.

Further, the connecting portion 93 has an approximately square pole shape, and multiple lightening portions 93*a* formed by lightening side surfaces of the connecting portion 93 are provided at intervals TA in the X direction in FIG. 9. Further, the connecting portion 93 is formed to have the side surfaces inclined by an angle of 45 degrees with respect to the Y direction. As described above, by forming the connecting portion 93 to have the side surfaces inclined by an angle of 45 degrees with respect to the Y direction, the linear portions of the multiple lightening portions 93*a* have the diagonals of a square. As a result, the linear portions of the multiple lightening portions 93*a* can be made longer when compared with a configuration in which the side surfaces of the connecting portion 93 are formed to become planes parallel to a plane perpendicular to the Y direction. Accordingly, a decrease in strength of the connecting portion 93 due to the lightening can be restrained.

Since the drive connecting member 90 is molded by, for example, injection molding, sink marks are generated, which may deform the first spherical portion 91 (i.e., a spherical portion facing the drive side coupling member 82), the second spherical portion 92 (i.e., a spherical portion facing the driven side coupling member 41), and the connecting portion 93. As a result, it is likely that the deformation affects the quality. Therefore, in the present embodiment, as described above, the first spherical portion 91, the second spherical portion 92 and the connecting portion 93 are lightened to restrain generation of the sink marks.

In the present embodiment, the respective thicknesses of the first spherical portion 91, the second spherical portion 92, and the non-lightening portion of the connecting portion 93 are set to be TA mm equally. Accordingly, the influence due to the sink marks of the first spherical portion 91, the second spherical portion 92, and the connecting portion 93 is restrained, and the drive connecting member 90 can be accurately molded.

As described above, the drive connecting member 90 is provided with the first spring holder 96*a* and the second spring holder 96*b* at both ends in the axial direction to receive the other end of the coil spring 73. With this configuration, even when either one of the first spherical portion 91 and the second spherical portion 92 is inserted into the opening 82*c* of the drive side coupling member 82, the drive connecting member 90 is assembled to the drive side coupling member 82. Accordingly, the drive connecting member 90 is assembled to the drive side coupling member 82 easily.

Next, a description is given of attachment of the drive connecting member 90 to the drive side coupling member 82, with reference to FIGS. 10A, 10B, 11A, 11B, 11C, 12A, 12B, 13A, 13B, 14A, and 14B.

Figure 10A:
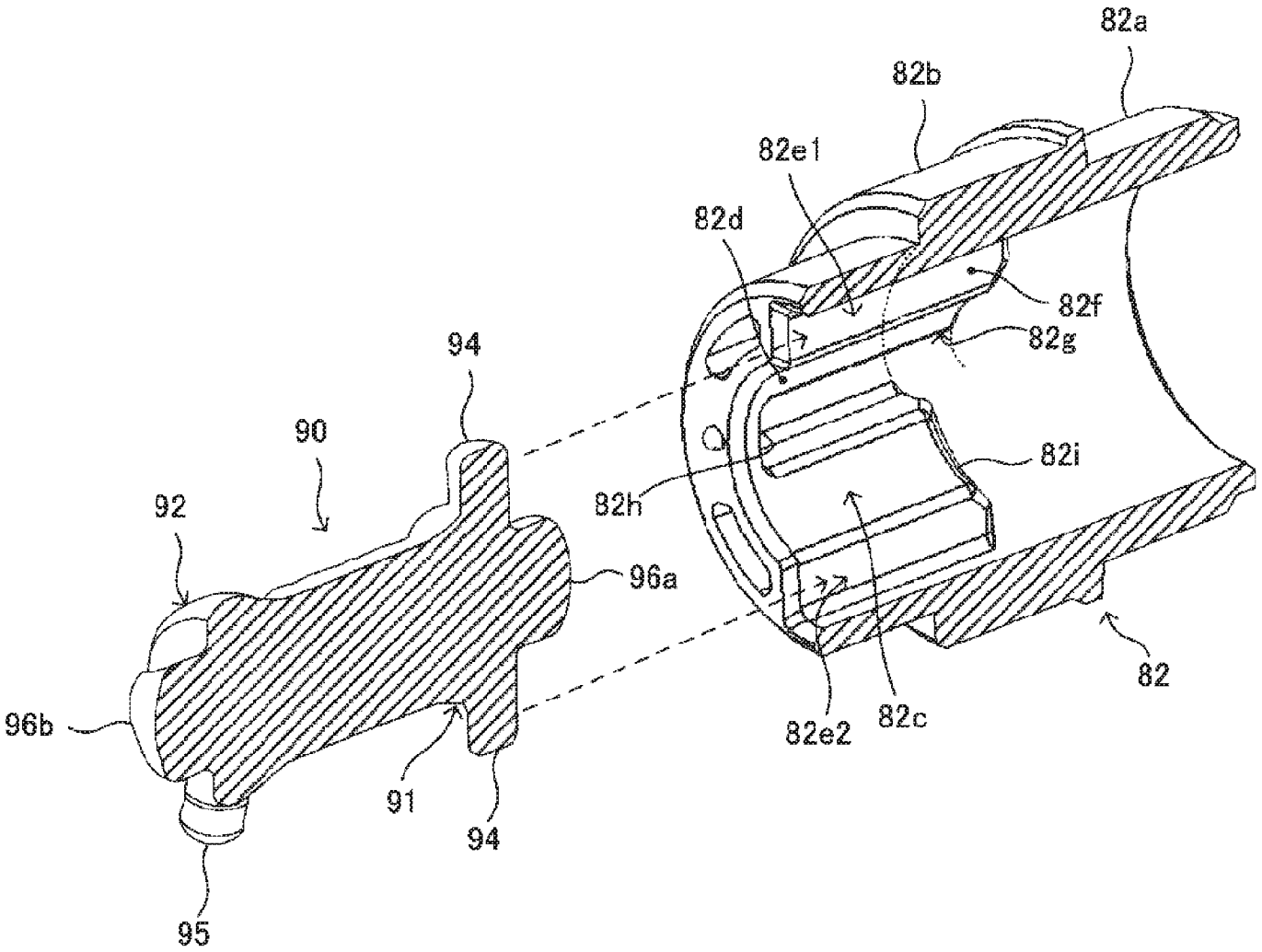
FIGS. 10A and 10B are diagrams illustrating the drive connecting member and a drive side coupling member before the drive connecting member is assembled to the drive side coupling member.
Figure 10B:
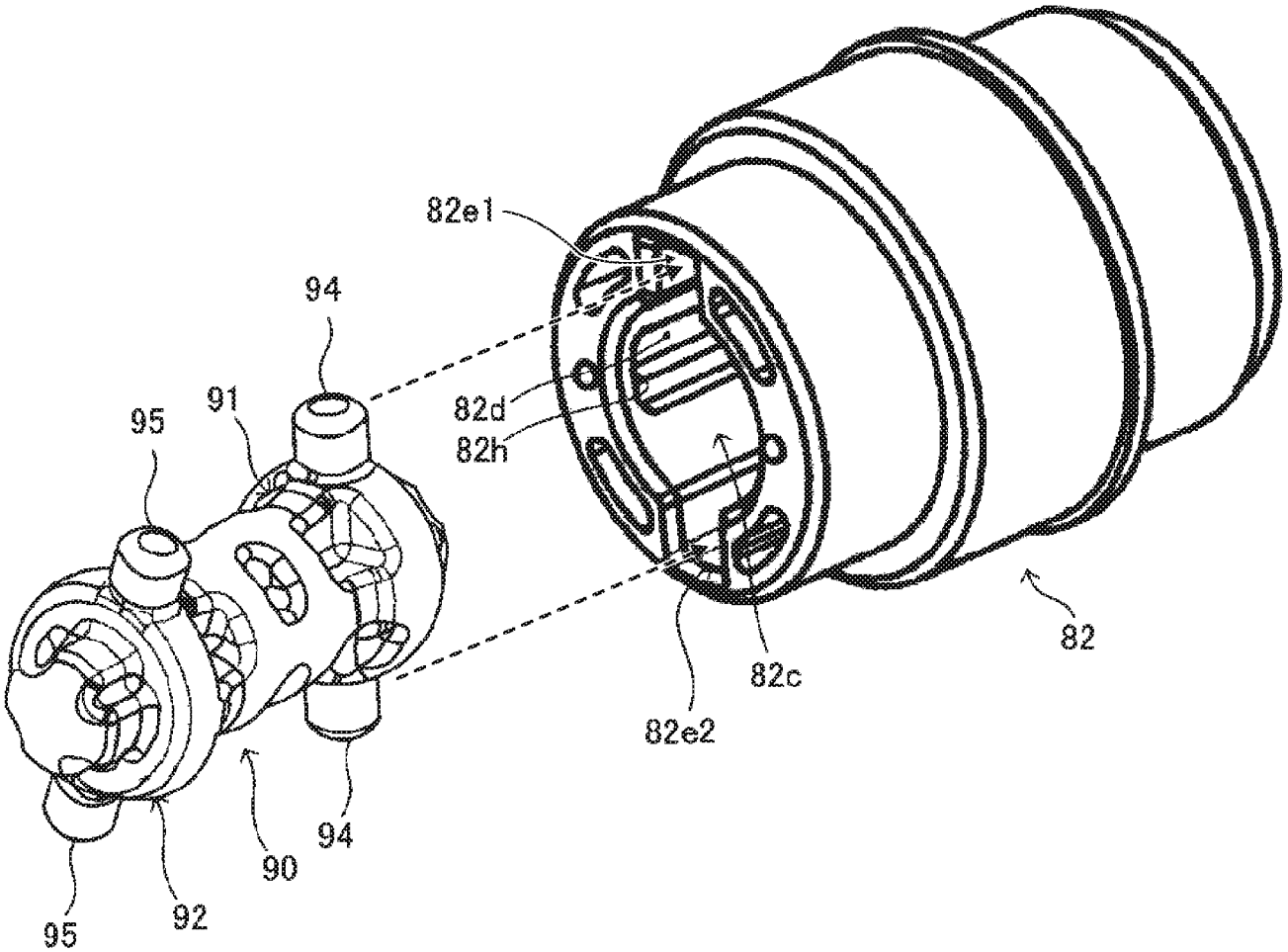
Figure 11A:
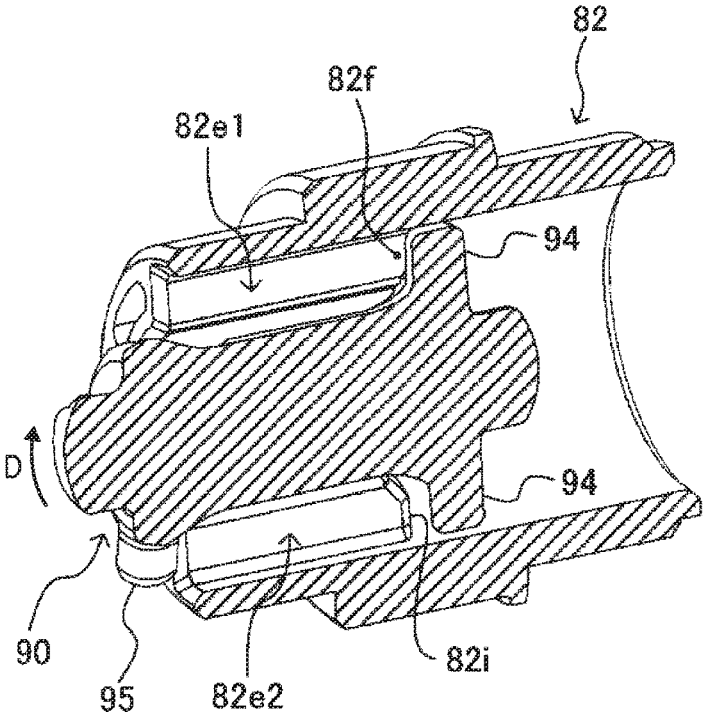
FIGS. 11A, 11B, and 11C are diagrams illustrating the drive connecting member and the drive side coupling member when the drive connecting member is inserted into the drive side coupling member until second projections of the drive connecting member contact the drive side coupling member.
Figure 11B:
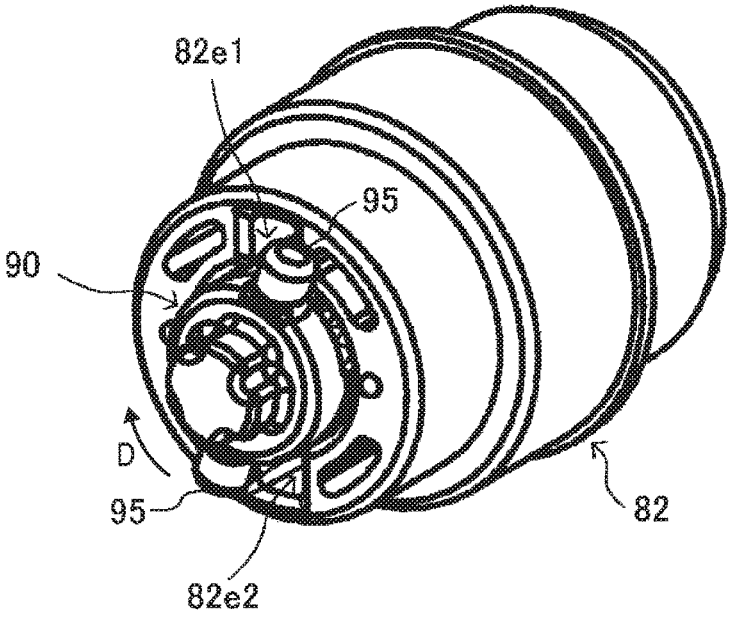
Figure 11C:
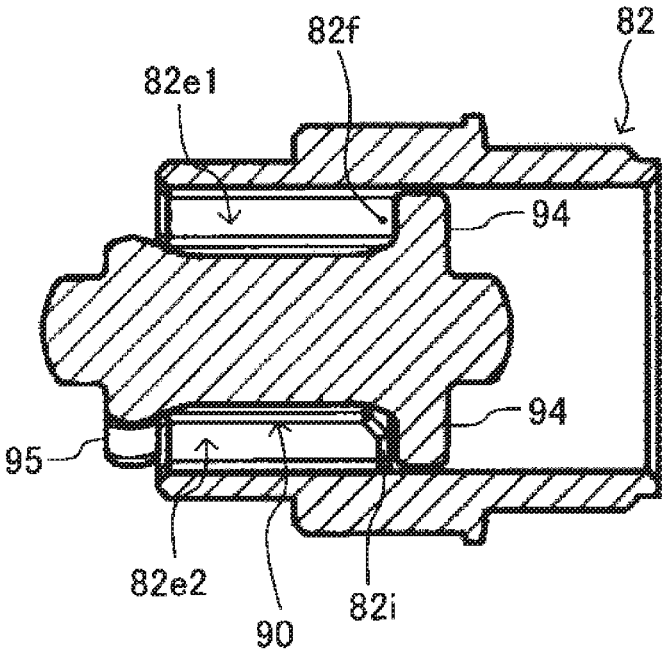
Figure 14A:
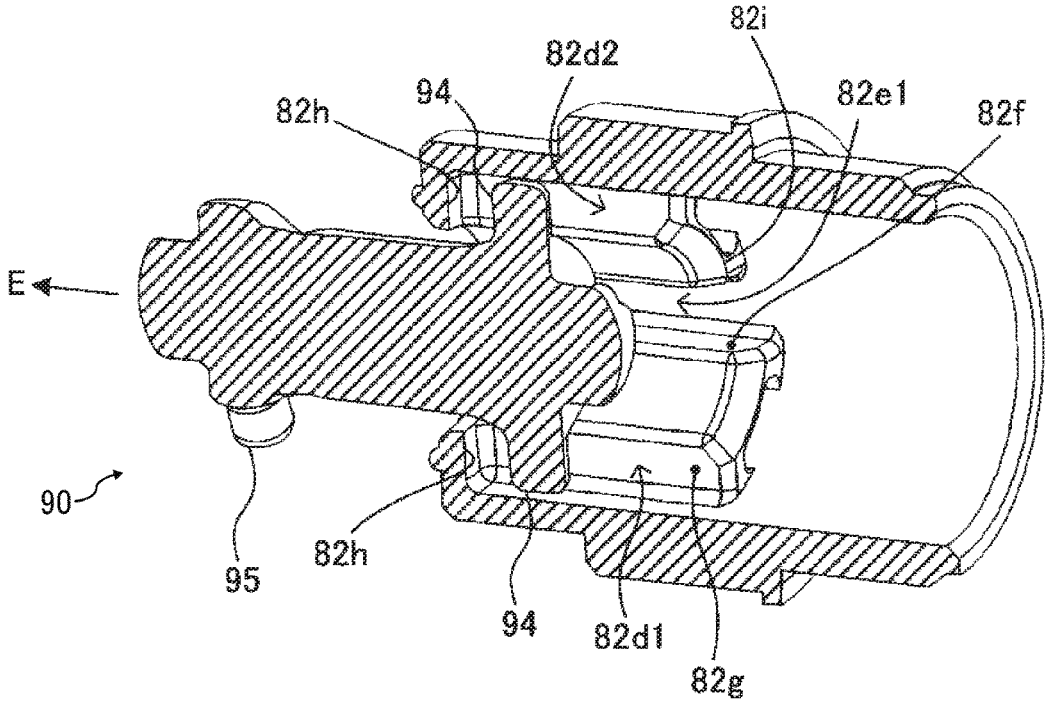
FIGS. 14A and 14B are diagrams illustrating the drive connecting member and the drive side coupling member when the drive connecting member is assembled to the drive side coupling member.
Figure 14B:
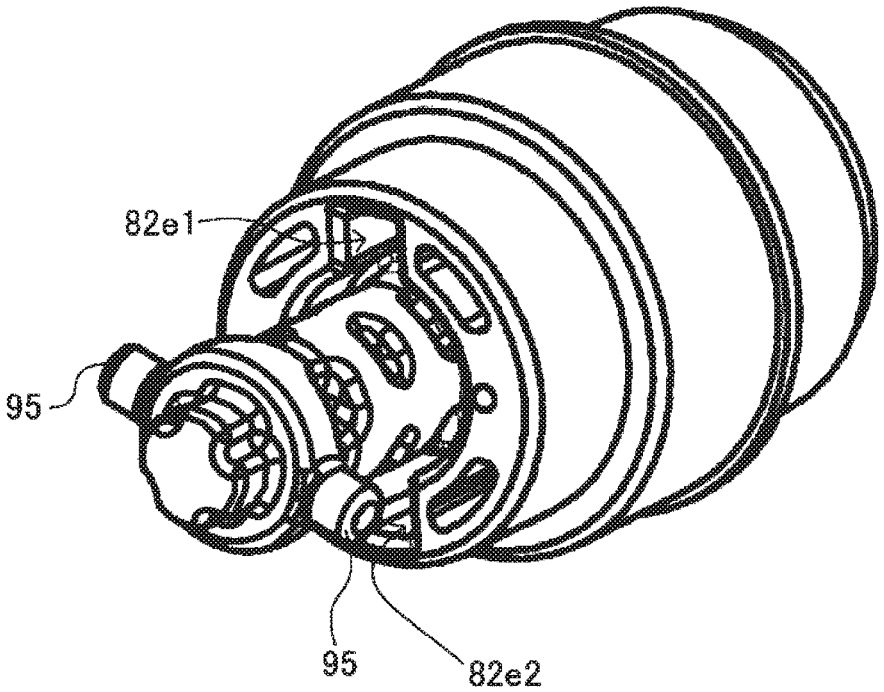

FIGS. 10A, 11A, and 14A are cross sectional perspective views illustrating the drive connecting member 90 and the drive side coupling member 82. FIGS. 10B, 11B, and 14B are perspective views illustrating the drive connecting member 90 and the drive side coupling member 82. FIG. 11C is a cross sectional view illustrating the drive connecting member 90 and the drive side coupling member 82.

It is to be noted that the following example describes a case in which the first spherical portion 91 of the drive connecting member 90 is inserted into the opening 82*c* of the drive side coupling member 82. However, instead of the first spherical portion 91 of the drive connecting member 90, the second spherical portion 92 of the drive connecting member 90 may be inserted into the opening 82*c* of the drive side coupling member 82.

First, as illustrated in FIGS. 10A and 10B, the position in the rotation direction of the drive connecting member 90 is adjusted with respect to the drive side coupling member 82 so that the first projections 94 are inserted into the guide grooves 82*e*1 and 82*e*2. Then, the first spherical portion 91 of the drive connecting member 90 is inserted into the opening 82*c*, and the first projections 94 are brought to be inserted into the guide grooves 82*e*1 and 82*e*2.

The second projections 95 of the drive connecting member 90 are provided at respective positions displaced from the first projections 94 of the drive connecting member 90 by an angle α in the rotation direction of the drive connecting member 90 (see FIG. 8A). In other words, the first projections 94 and the second projections 95 are disposed at different positions from each other in the rotation direction of the drive connecting member 90. Therefore, as the drive connecting member 90 enters into the drive side coupling member 82, as illustrated in FIGS. 11A and 11B, the second projections 95 contact the unit side face of the drive side coupling member 82, and therefore the second projections 95 do not enter into the guide grooves 82*e*1 and 82*e*2. Accordingly, the drive connecting member 90 does not come out from the side end of the side plate 1*b* of the drive side coupling member 82, and the drive connecting member 90 is assembled to the drive side coupling member 82 easily.

Figure 12A:
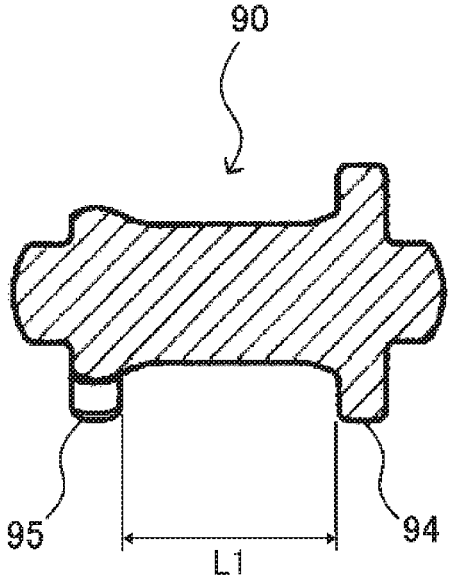
FIGS. 12A and 12B are diagrams illustrating dimensions of the drive connecting member and the drive side coupling member.
Figure 12B:
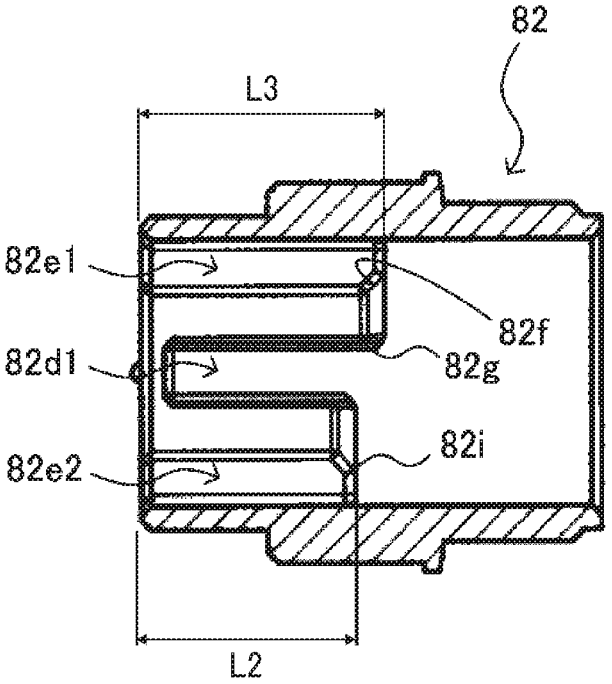

FIGS. 12A and 12B are diagrams illustrating dimension of the drive connecting member 90 and the drive side coupling member 82.

As illustrated in FIGS. 12A and 12B, a length L1 from the second projection side end of the first projections 94 to the first projection side end of the second projections 95 is equal to or greater than a length L2 from the unit side end of the drive side coupling member 82 to the communication portion 82*i*. Therefore, as illustrated in FIGS. 11A through 11C, when the drive connecting member 90 is inserted into the drive side coupling member 82 until the second projections 95 contact the unit side end face of the drive side coupling member 82, the first projections 94 reach the communication portion 82*i* in which the guide grooves 82*e*1 and 82*e*2 and the drive side grooves 82*d*1 and 82*d*2 communicate with each other.

When the second projections 95 contact the unit side end face of the drive side coupling member 82, the drive connecting member 90 is rotated in a direction indicated by arrow D in FIGS. 11A and 11B so that the first projections 94 are inserted into (and positioned to) the drive side grooves 82*d*1 and 82*d*2.

In the present embodiment, one side surface of the guide groove 82*e*1 has the regulator 82*f* that is extended toward the side plate 1*b* more than the other side surface of the guide groove 82*e*1 is. As illustrated in FIGS. 12A and 12B, a length L3 in the axial direction from the side plate side end of the one side surface of the guide groove 82*e*1 having the regulator 82*f* to the unit side end of the drive side coupling member 82 is set to be longer than the length L1 to the first projection side end of the second projections 95. Therefore, as illustrated in FIGS. 11A through 11C, when the drive connecting member 90 is inserted into the drive side coupling member 82 until the second projections 95 contact the unit side end face of the drive side coupling member 82, the first projections 94 is brought to face the regulator 82*f*. Accordingly, the rotation of the second projections 95 of the drive connecting member 90 in a direction opposite the shifting direction (i.e., the direction D in FIGS. 11A and 11B) with respect to the first projections 94 is restricted by the regulator 82*f*. In a case in which the drive connecting member 90 is rotatable in a direction opposite the shifting direction of the second projections 95 with respect to the first projections 94, when the drive connecting member 90 is rotated in that direction, the second projections 95 pass through the guide grooves 82*e*1 and 82*e*2. While the second projections 95 are passing through the guide grooves 82*e*1 and 82*e*2, it is likely that the second projections 95 enter into the guide grooves 82*e*1 and 82*e*2 to cause the drive connecting member 90 to come out from the side of the side plate 1*b* of the drive side coupling member 82.

By contrast, in the present embodiment, the regulator 82*f* restricts the rotation of the second projections 95 in the direction opposite the shifting direction with respect to the first projections 94. By so doing, the second projections 95 are prevented from entering into the guide grooves 82*e*1 and 82*e*2, and therefore the drive connecting member 90 is prevented from coming out from the side of the side plate 1*b* of the drive side coupling member 82. Accordingly, the drive connecting member 90 is assembled to the drive side coupling member 82 easily.

Figure 13A:
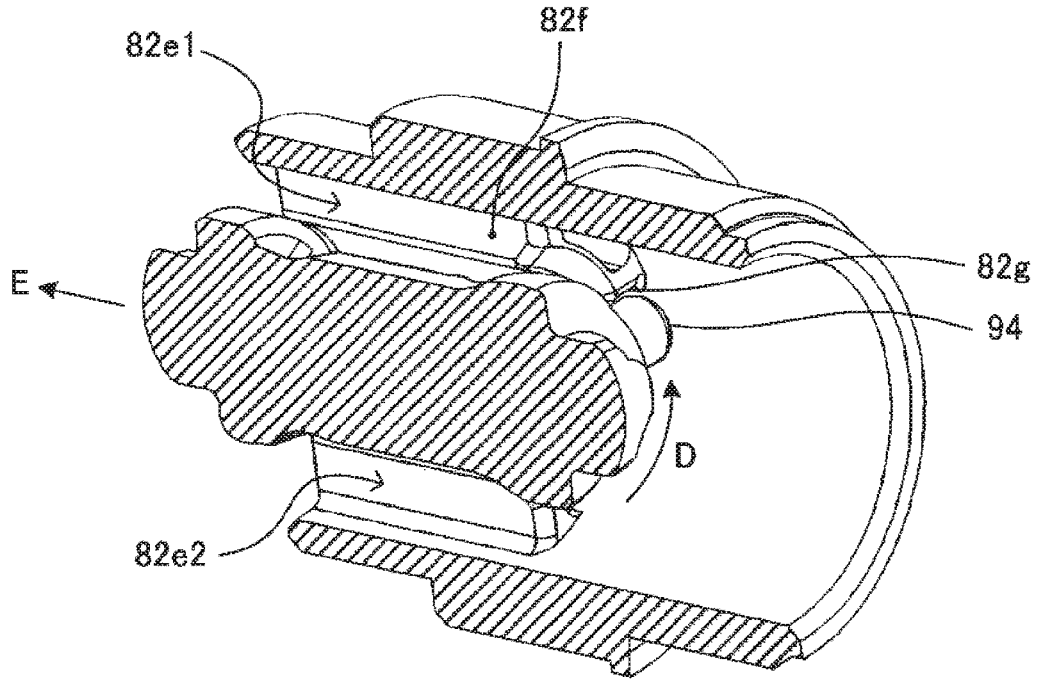
FIGS. 13A and 13B are diagrams illustrating the drive connecting member and the drive side coupling member when first projections of the drive connecting member are inserted into drive side grooves of the drive side coupling member.
Figure 13B:
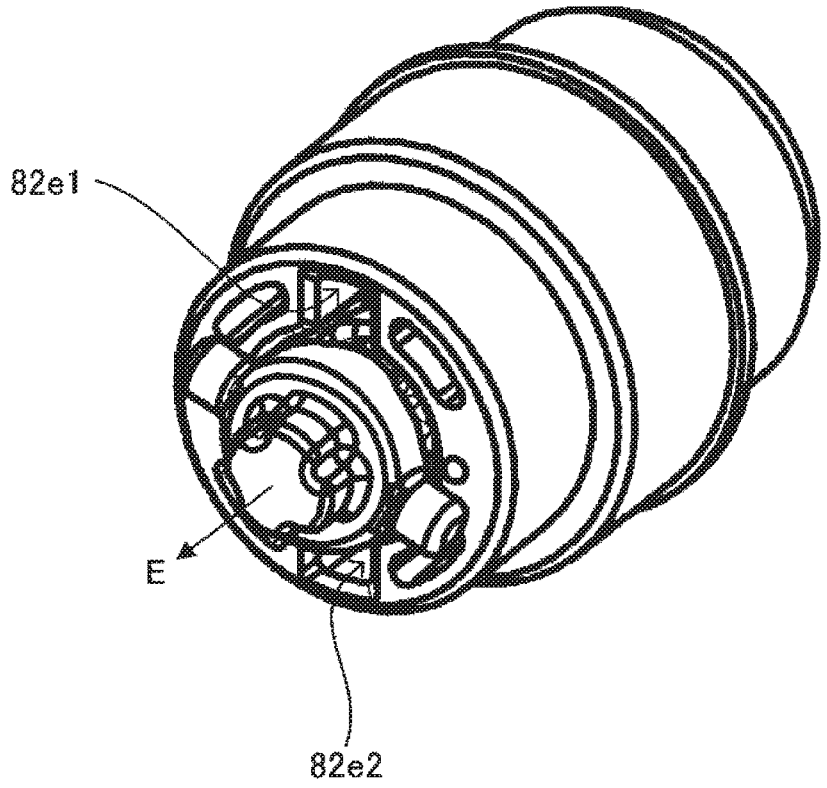

Further, in the present embodiment, the regulator 82*g* is provided to the drive side coupling member 82 to restrict the rotation of the drive connecting member 90 in the direction D by extending the side surface of the drive side groove 82*d*1 opposite the communication portion 82*i* more than the side surface of the communication portion 82*i*. As illustrated in FIGS. 12A and 12B, the length in the axial direction from the side plate side end of the one side surface of the drive side groove 82*d*1 having the regulator 82*g* to the unit side end of the drive side coupling member 82 is equal to the length L3 in the axial direction from the side plate side end of the one side surface of the guide groove 82*e*1 having the regulator 82*f* to the unit side end of the drive side coupling member 82. This length is longer than the length L1 to the first projection side end of the second projections 95. Therefore, when the drive connecting member 90 is rotated in the direction D from the state of FIGS. 11A through 11C and the first projections 94 reach the drive side grooves 82*d*1 and 82*d*2 as illustrated in FIGS. 13A and 13B, the first projections 94 contact the regulator 82*g* to restrict the rotation of the drive connecting member 90. As a result, it is clear that the first projections 94 have reached the drive side grooves 82*d*1 and 82*d*2 without checking visually. Accordingly, the first projections 94 is easily positioned to the drive side grooves 82*d*1 and 82*d*2, and therefore the drive connecting member 90 is easily assembled to the drive side coupling member 82.

Then, when the first projections 94 contact the regulator 82*g* and the rotation of the drive connecting member 90 is restricted, the drive connecting member 90 is moved to the unit side (i.e., in a direction indicated by arrow E in FIGS. 13A and 13B) to cause the first projections 94 to enter into the drive side grooves 82*d*1 and 82*d*2. Consequently, the drive connecting member 90 is assembled to the drive side coupling member 82. Thereafter, the drive side coupling member 82 to which the drive connecting member 90 is assembled is attached to the metal stud 100 that contains the spring holder 101 and the coil spring 73.

In the present embodiment, the angle α (see FIG. 8A) in the rotation direction of the second projections 95 with respect to the first projections 94 is set to be less than the angle (i.e., 90 degrees) in the rotation direction between the drive side groove 82*d* (i.e., the drive side grooves 82*d*1 and 82*d*2) and the guide grooves 82*e* (i.e., the guide grooves 82*e*1 and 82*e*2). Consequently, the angle α in the rotation direction of the second projections 95 with respect to the first projections 94 is different from an angle in the rotation direction between the drive side grooves 82*d*1 and 82*d*2 and the guide grooves 82*e*1 and 82*e*2. Therefore, as illustrated in FIGS. 13A and 13B, when the first projections 94 are inserted into the drive side grooves 82*d*1 and 82*d*2 to assemble the drive connecting member 90 to the drive side coupling member 82, the second projections 95 are located at the positions shifted from each other in the rotation direction with respect to the guide grooves 82*e*1 and 82*e*2. According to this configuration, after the drive connecting member 90 has been assembled to the drive side coupling member 82, the second projections 95 are prevented from entering into the guide grooves 82*e*1 and 82*e*2, and therefore the drive connecting member 90 is prevented from coming out from the side plate side of the drive side coupling member 82. Accordingly, the drive side coupling member 82 to which the drive connecting member 90 has been assembled is attached to the metal stud 100 easily.

Figure 15:
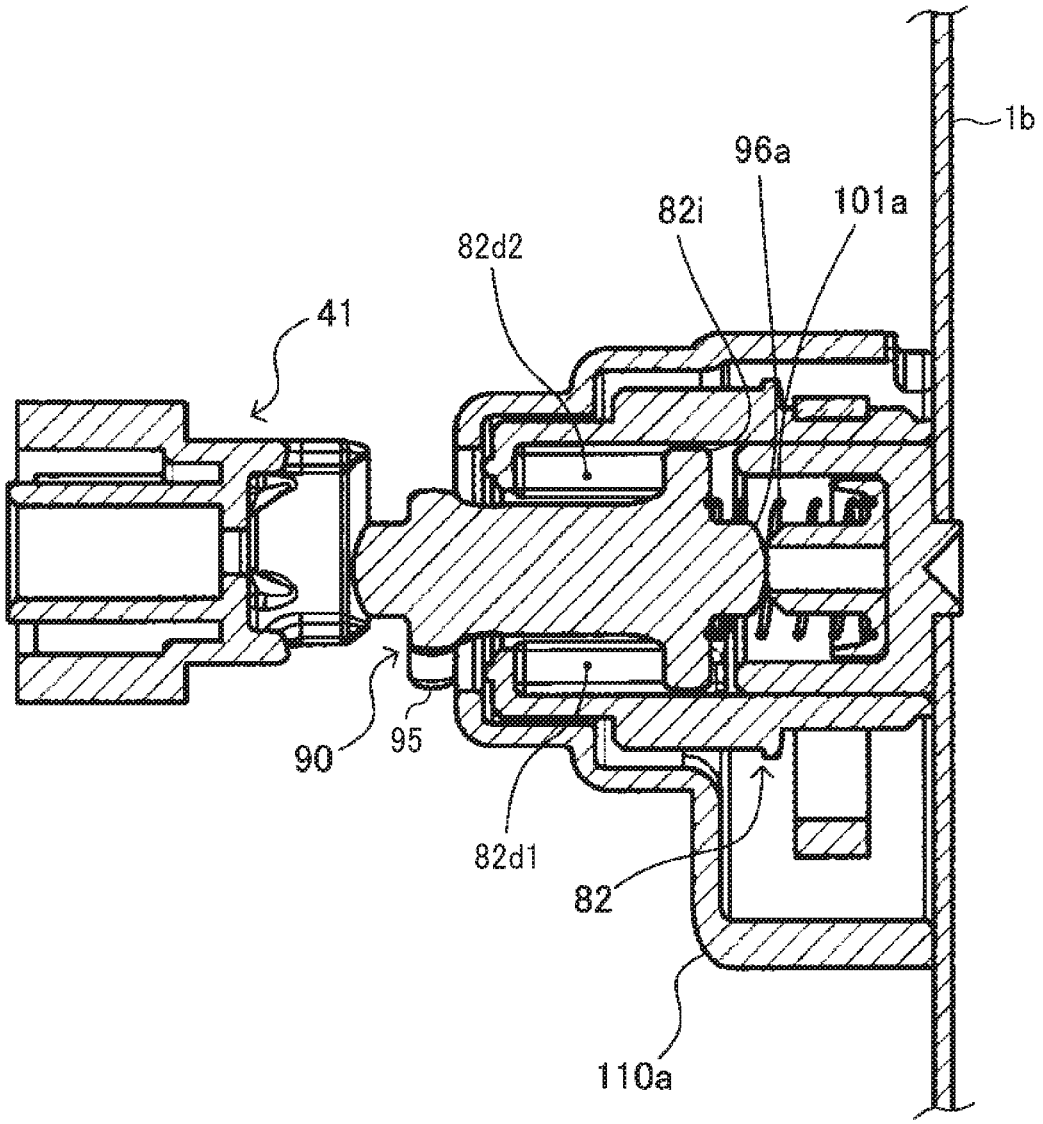
FIG. 15 is a diagram illustrating restriction of movement of the drive connecting member by a regulator of a spring holder toward a side plate.

FIG. 15 is a diagram illustrating restriction of movement of the drive connecting member 90 toward the side plate 1*b* by the regulator 101*a* of the spring holder 101.

As illustrated in FIG. 15, as the drive connecting member 90 is pressed toward the side plate 1*b*, the first spring holder 96*a* of the drive connecting member 90 contacts to or abuts against the regulator 101*a* of the spring holder 101 before the first projections 94 in the drive side grooves 82*d*1 and 82*d*2 reach the communication portion 82*i*. As a result, the first projections 94 in the drive side grooves 82*d*1 and 82*d*2 do not move to the guide grooves 82*e*1 and 82*e*2 via the communication portion 82*i*. Consequently, after the drive side coupling member 82 is supported by the metal stud 100 in which the spring holder 101 is contained, the drive connecting member 90 does not come out from the drive side coupling member 82.

Next, a description is given of drive connection of the drive connecting member 90 and the driven side coupling member 41.

When attaching the first unit 150 to the drive transmitting device 70, in a case in which the phase of the driven side coupling member 41 that is attached to the first stud 151*a* and the phase of the drive connecting member 90 are not matched, each of the second projections 95 contacts an edge of the coupling portion 41*b* of the driven side coupling member 41. In a case in which the first unit 150 is further pressed toward the device body of the drive transmitting device 70 in this state, the drive connecting member 90 moves toward the side plate 1*b* while compressing the coil spring 73. Accordingly, even when the driven side coupling member 41 and the drive connecting member 90 are not drivingly connected, the first unit 150 is reliably attached to the device body of the drive transmitting device 70.

As the drive connecting member 90 is rotated together with the drive side coupling member 82, the phase of each of the second projections 95 and the phase of the driven side grooves 142 are matched, and therefore the drive connecting member 90 moves toward the first unit 150 by the biasing force of the coil spring 73. As a result, the second spherical portion 92 is inserted into the coupling portion 41*b* and each of the second projection 95 is inserted into the driven side grooves 142. Accordingly, the drive connecting member 90 and the driven side coupling member 41 are drivingly connected, and the driving force is transmitted from the drive connecting member 90 to the driven side coupling member 41.

When there is a gap between the rotation center of the driven side coupling member 41 and the rotation center of the drive side coupling member 82 (hereinafter, the gap is referred to as an axis misalignment), the drive connecting member 90 is inclined to connect the drive transmission, as illustrated in FIG. 5. In the present embodiment, the first spherical portion 91 of the drive connecting member 90 that is inserted into the drive side coupling member 82 and the second spherical portion 92 of the drive connecting member 90 that is inserted into the driven side coupling member 41 have respective spherical shapes. In addition, the respective top surfaces of the first spring holder 96*a* and the second spring holder 96*b* have respective spherical shapes. Accordingly, in a case in which the axis misalignment is generated, the drive connecting member 90 is smoothly inclined, and therefore the axis misalignment is preferably reduced or cancelled. To be more specific, the arc-shaped surfaces of the first drive side large circle 91*a*, the second drive side large circle 91*b*, and the third drive side large circle 91*c* of the first spherical portion 91 that is inserted into the opening 82*c* of the drive side coupling member 82 smoothly slide on the inner circumferential surface of the opening 82*c*, and the drive connecting member 90 is smoothly inclined with respect to the drive side coupling member 82.

Further, the arc-shaped surfaces of the first driven side large circle 92*a*, the second driven side large circle 92*b*, and the third driven side large circle 92*c* of the second spherical portion 92 that is to be inserted into the coupling portion 41*b* of the driven side coupling member 41 smoothly slides on the circumferential surface of the coupling portion 41*b*, and the spherical top surface of the second spring holder 96*b* smoothly slides on the bottom face of the coupling portion 41*b*, and the drive connecting member 90 is smoothly inclined with respect to the driven side coupling member 41. Accordingly, the drive connecting member 90 is smoothly inclined to reduce or cancel the axis misalignment.

Further, in the present embodiment, the first projections 94 of the drive connecting member 90 to which the driving force is transmitted from the drive side coupling member 82 and the second projections 95 that transmits the driving force to the driven side coupling member 41 have cylindrical shapes. According to this configuration, the projections of the present embodiment (i.e., the first projections 94 and the second projections 95) are more restrained from the angular speed variations when the axial misalignment is generated, when compared with a comparative configuration in which projections have hemisphere shapes.

Figure 16A:
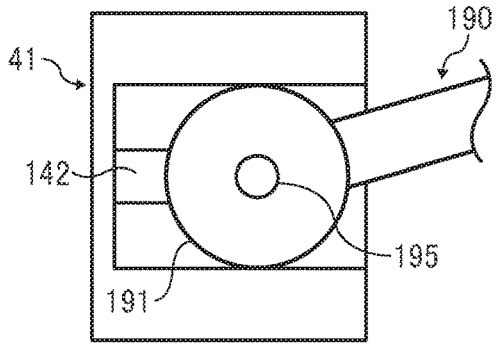
FIGS. 16A, 16B, and 16C are diagrams illustrating drive transmission between a comparative drive connecting member having first and second projections having a hemispherical shape and a driven side coupling member in a comparative drive transmitting device.
Figure 16B:
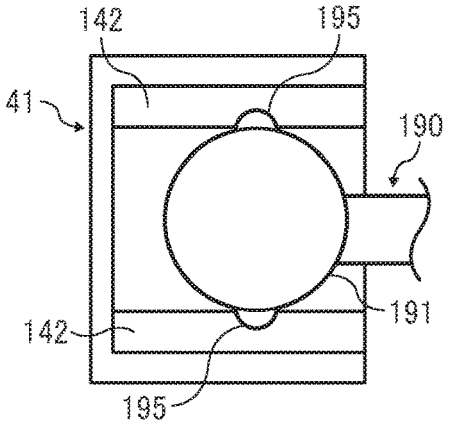
Figure 16C:
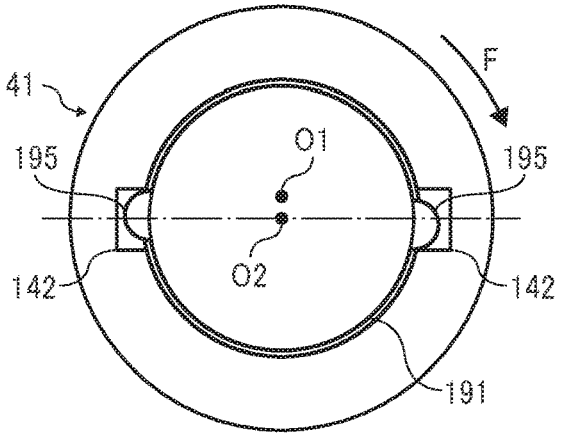
Figure 17A:
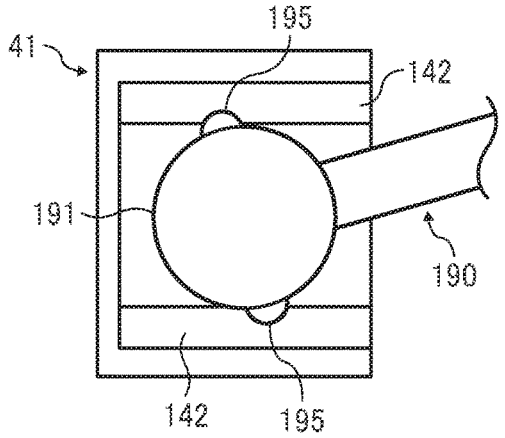
FIGS. 17A, 17B, and 17C are diagrams illustrating the comparative drive connecting member and the driven side coupling member, viewed when rotated by an angle of 90 degrees from the states of FIGS. 16A, 16B, and 16C, respectively.
Figure 17B:
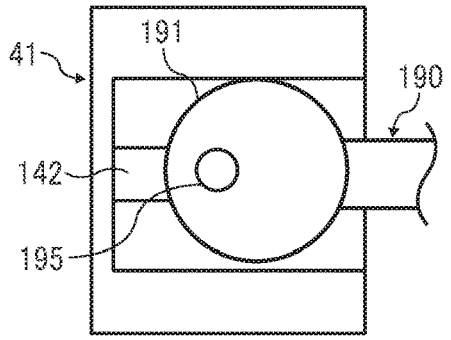
Figure 17C:
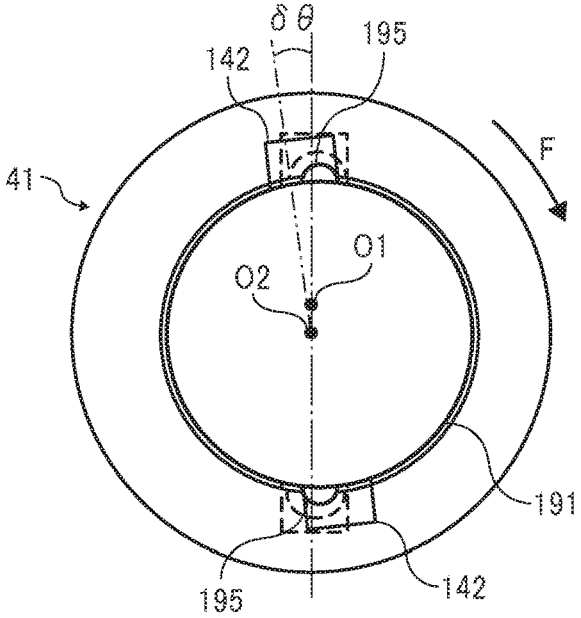

FIGS. 16A, 16B, and 16C are diagrams illustrating drive transmission between a comparative drive connecting member 190 having first and second projections having respective hemispherical shapes and the driven side coupling member 41 in a comparative drive transmitting device. Specifically, FIG. 16A is a diagram illustrating the comparative drive connecting member 190 and the driven side coupling member 41, viewed from a direction perpendicular to a direction of inclination of the comparative drive connecting member 190. FIG. 16B is a top view of FIG. 16A. FIG. 16C is a diagram illustrating the comparative drive connecting member 190 and the driven side coupling member 41, viewed from the axial direction of the comparative drive connecting member 190. FIGS. 17A, 17B, and 17C are diagrams illustrating drive transmission between the comparative drive connecting member 190 having first and second projections having the respective hemispherical shapes and the driven side coupling member 41 in the comparative drive transmitting device when rotated by 90 degrees from the state in FIGS. 16A, 16B, and 16C. Specifically, FIG. 17A is a diagram of the comparative drive connecting member 190 and the driven side coupling member 41, viewed from the direction perpendicular to the direction of inclination of the comparative drive connecting member 190. FIG. 17B is a top view of FIG. 17A. FIG. 17C is a diagram of the comparative drive connecting member 190 and the driven side coupling member 41, viewed from the axial direction of the comparative drive connecting member 190.

It is to be noted that, in FIGS. 16A, 16B, 16C, 17A, 17B and 17C, a reference letter "O2" indicates the shaft core of the driven side coupling member 41, a reference letter "O1" indicates a shifted shaft core, and reference numeral "191" indicates a shape of a coupled portion formed by coupling of the driven side coupling member 41 and the comparative drive connecting member 190.

In a case in which second projections 195 have a hemisphere shape, each of the second projections 195 forms an arc shape in which a downstream end of the rotation direction of the second projections 195, which is a groove contacting portion contacting a side surface of the driven side grooves 142, is positioned to an upstream side of the rotation direction, as the downstream end of the rotation direction of the second projections 195 move toward the top, as illustrated in FIG. 17C. As illustrated in FIGS. 16A through 16C, when the protruding direction of the second projections 195 is a direction perpendicular to a direction of axis misalignment, the substantially entire area of the second projections 195 enter the driven side grooves 142. Therefore, in this case, the root sides of the second projections 195 contact respective side surfaces of the driven side grooves 142, as illustrated in FIG. 16C.

From this state, when the comparative drive connecting member 190 is rotated in a direction indicated by arrow F in FIG. 16C, the second projections 195 on the left side of FIG. 16C is moved inside one of the driven side grooves 142 toward the first unit and the second projection 195 on the right side of FIG. 16C is moved inside the other of the driven side grooves 142 toward the side plate. At this time, as respective entering amounts of the second projections 195 to the driven side grooves 142 are decreased, the contacting positions of the second projections 195 to the driven side groove side surfaces are changed toward the top side. In the case in which the second projections 195 have a hemisphere shape, the downstream end of the rotation direction of the second projections 195, which contact the driven side grooves 142, is positioned to the upstream side of the rotation direction, as the downstream end of the rotation direction of the second projections 195 approach the top, as described above. Therefore, as illustrated in FIG. 16C, even when the comparative drive connecting member 190 is rotated by an angle of 90 degrees, the driven side coupling member 41 is not rotated by an angle of 90 degrees and is located at a position retracted in the rotation direction by an angle $\delta\theta$, and the angular speed of the driven side coupling member 41 is delayed from the angular speed of the comparative drive connecting member 190.

Then, when the comparative drive connecting member 190 is further rotated in the direction indicated by arrow F in FIG. 17C from the state of FIGS. 17A through 17C, the second projections 195 positioned at the upper side in FIG. 17A is moved toward the side plate in the driven side grooves 142. Further, the second projections 195 that are positioned at a lower side in FIG. 17A are moved in the driven side grooves 142 toward the first unit. At this time, the state in FIGS. 17A through 17C is the same as the state in FIGS. 16A through 16C, except that, as the contact position of the second projections 195 to the side surface of the driven side grooves 142 is changed from the top to the root and the comparative drive connecting member 190 is rotated by an angle of 90 degrees from the state of FIGS. 16A through 16C to be rotated by an angle of 180 degrees in total, the positions of the second projections 195 and the driven side grooves 142 are switched. At this time, the delay of the driven side coupling member 41 is canceled and is rotated by an angle of 180 degrees, that is similar to the comparative drive connecting member 190. In other words, while the driven side coupling member 41 is rotated by an angle of 90 degrees from the state of FIGS. 17A through 17C, the driven side coupling member 41 is rotated more by the angle $\delta\theta$, and the angular speed becomes faster with respect to the comparative drive connecting member 190. Accordingly, in the case in which the second projections 195 have a hemisphere shape, the angular speed variation has a half (½) rotation period.

In the above description, the speed variation between the comparative drive connecting member 190 and the driven side coupling member 41 has been described. However, in a case in which the second projections 195 have a hemisphere shape, the comparative drive connecting member 190 has speed variation in a half (½) period between the drive side coupling member 82 and the comparative drive connecting member 190.

Figure 18A:
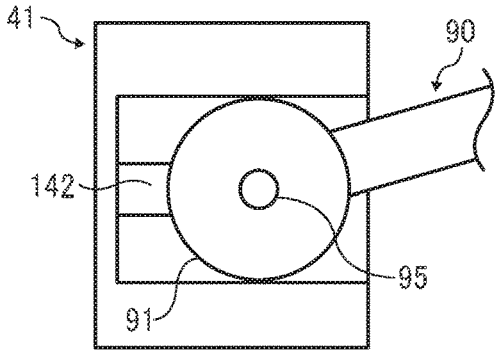
FIGS. 18A, 18B, and 18C are diagrams illustrating drive transmission between the drive connecting member and the driven side coupling member of the drive transmitting device according to an embodiment of this disclosure.
Figure 18B:
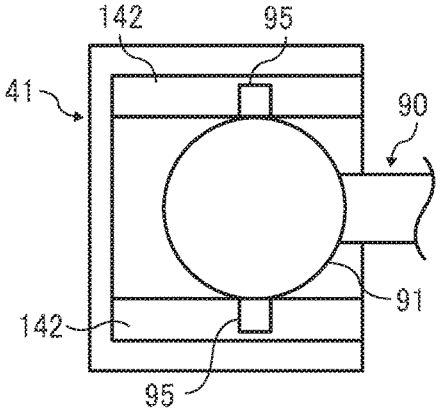
Figure 18C:
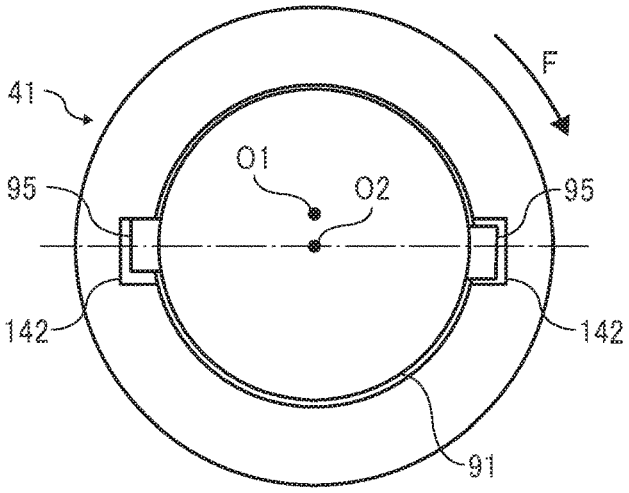
Figure 19A:
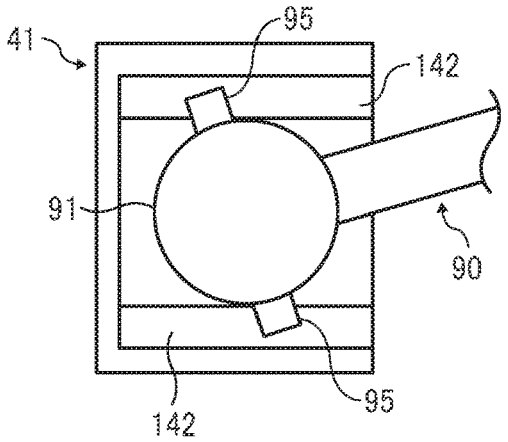
FIGS. 19A, 19B, and 19C are diagrams illustrating the drive connecting member and the driven side coupling member, viewed when rotated by an angle of 90 degrees from the states of FIGS. 18A, 18B, and 18C, respectively.
Figure 19B:
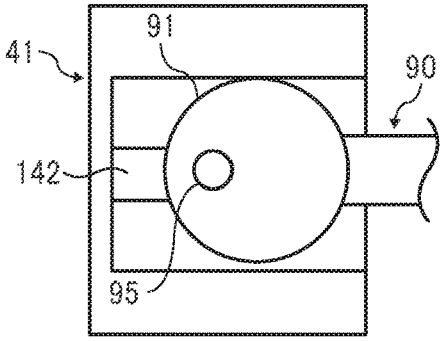
Figure 19C:
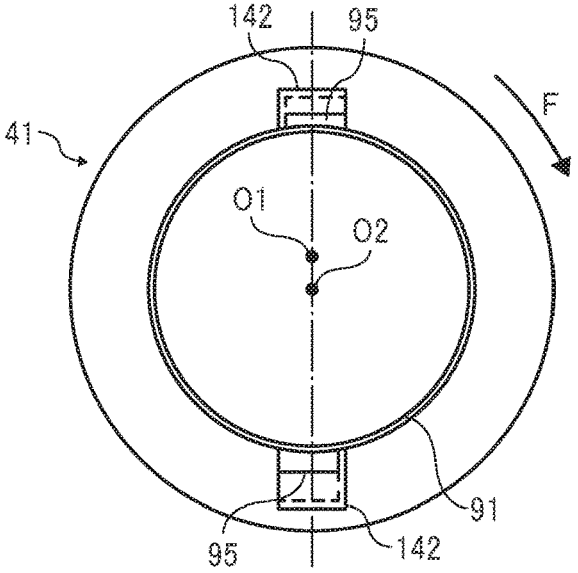

FIGS. 18A, 18B, and 18C are diagrams illustrating drive transmission of the drive connecting member 90 and the driven side coupling member 41 according to the present embodiment. Specifically, FIG. 18A is a diagram illustrating the driven side coupling member 41 and the drive connecting member 90, viewed from a direction perpendicular to an angularly shifted direction of the drive connecting member 90. FIG. 18B is a diagram illustrating the driven side coupling member 41 and the drive connecting member 90, viewed from the top of FIG. 18A. FIG. 18C is a diagram it the driven side coupling member 41 and the drive connecting member 90, viewed from the axial direction. FIGS. 19A, 19B, and 19C are diagrams illustrating states in which the drive connecting member 90 and the driven side coupling member 41 of the drive transmitting device are rotated by an angle of 90 degrees from the states of FIGS. 18A, 18B, and 18C, respectively. Specifically, FIG. 19A is a diagram illustrating the driven side coupling member 41 and the drive connecting member 90, viewed from a direction perpendicular to the angularly shifted direction of the drive connecting member 90. FIG. 19B is a diagram illustrating the driven side coupling member 41 and the drive connecting member 90, viewed from the top of FIG. 19A. FIG. 19C is a diagram illustrating the driven side coupling member 41 and the drive connecting member 90, viewed from the axial direction.

In the present embodiment, the second projections 95 have a columnar shape. Accordingly, as illustrated in FIG. 18C, downstream side ends in the rotation direction of the second projections 95 function as groove contacting portions to contact side surfaces of the driven side grooves 142. The downstream side ends in the rotation direction of the second projections 95 have a linear shape that linearly extends in the radial direction. A contact portion of each of the second projections 95 contacts a corresponding one of the driven side grooves 142 at the same position from the root to the top in the rotation direction. When the drive connecting member 90 is rotated in the direction indicated by arrow F in FIG. 18C from the state illustrated in FIGS. 18A through 18C, respective entering amounts of the second projections 95 to the driven side grooves 142 are decreased. When the drive connecting member 90 is rotated by an angle of 90 degrees, as illustrated in FIG. 19C, the top sides alone of the second projections 95 enter the driven side grooves 142. As a result, the downstream side ends of the rotation direction at the tops of the second projections 95 contact the side surfaces of the driven side grooves 142. However, since the downstream side ends in the rotation direction of the second projections 95 have a linear shape linearly extending in the radial direction, even when the downstream side ends alone in the rotation direction at the tops of the second projections 95 contact the side surfaces of the driven side grooves 142, the driven side coupling member 41 is rotated by the same angle as the drive connecting member 90 without being delayed from the rotation of the drive connecting member 90. Accordingly, even when the axial misalignment is generated, the driven side coupling member 41 is rotated at a constant speed.

Similarly, each of the first projections 94 has a columnar shape, and thus the drive connecting member 90 is rotated at a constant speed without causing the angular speed variation in drive transmission from the drive side coupling member 82 to the drive connecting member 90 due to the shape of the projections (i.e., the first projections 94).

Further, in the present embodiment, the first projections 94 and the second projections 95 have columnar shapes. By so doing, the downstream side ends in the rotation direction that correspond to groove contact portions that contact the side surfaces of the drive side grooves 82*d*1 and 82*d*2 and the driven side grooves 142 have respective arc surfaces protruding in the rotation direction. As a result, the contact between any one of the first projections 94 and the second projections 95 and a corresponding one of the drive side grooves 82*d*1 and 82*d*2 and the driven side grooves 142 becomes point connection, as viewed from the radial direction. Accordingly, the drive connecting member 90 is smoothly inclined in the direction perpendicular to the protruding direction of the first projections 94 and the second projections 95, as illustrated in FIG. 18A. It is to be noted that the point connection is an ideal state in design and includes, in reality, a state having some mounts of a contact width.

Figure 20:
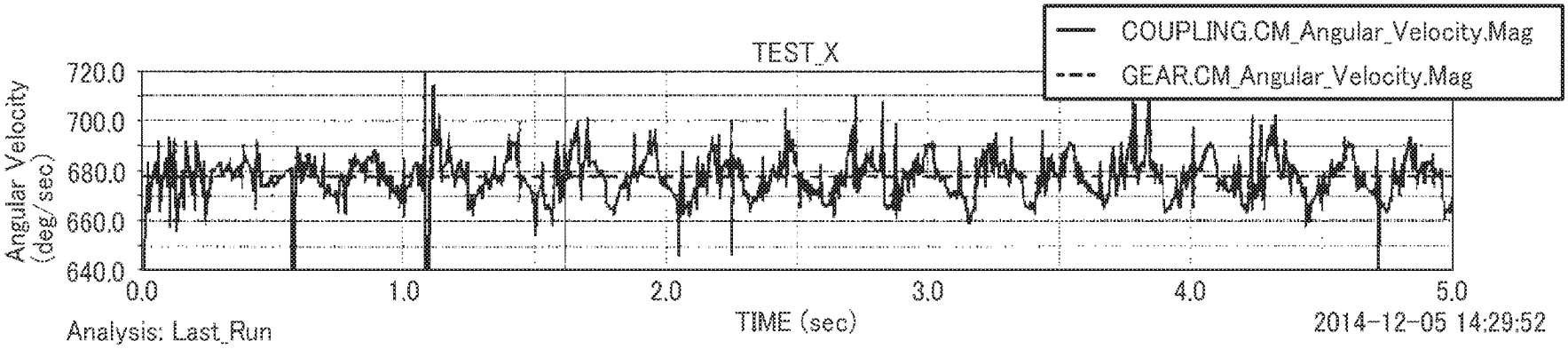
FIG. 20 is a graph illustrating speed variations of a first roller examined when the comparative drive connecting member provided with the first projection and the second projection of a hemispherical shape is used.

FIG. 20 is a graph illustrating speed variations of the first roller 152 checked when an axial center of the driven side coupling member 41 is shifted from a center of a rotation shaft of the drive side coupling member 82 by a predetermined amount and coupled to the drive side coupling member 82, using the comparative drive connecting member 190 with the first projections and the second projections having hemisphere shapes. As illustrated in FIG. 20, the first roller 152 has speed variations generated at the predetermined cycle.

Figure 21:
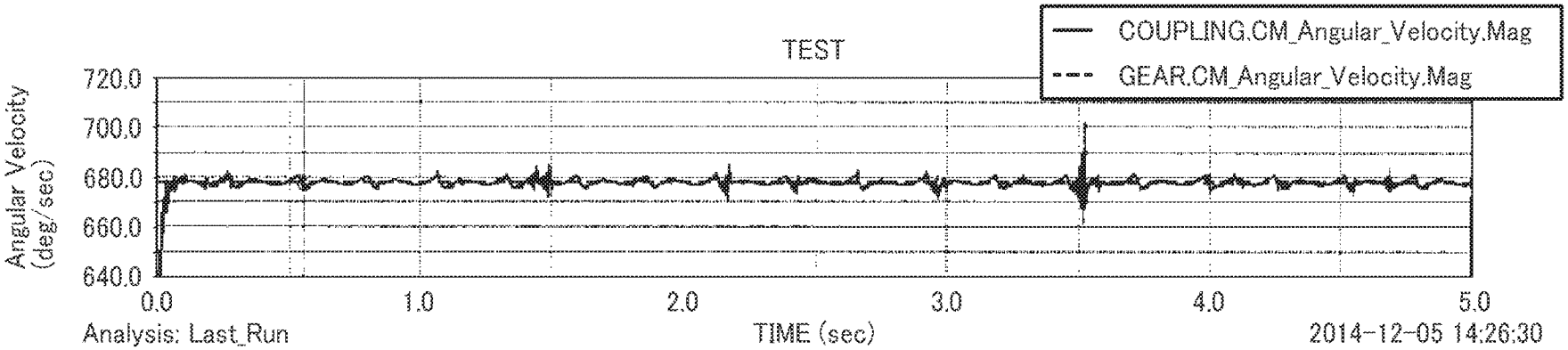
FIG. 21 is a graph illustrating speed variations of the first roller examined when the drive connecting member according to the present embodiment is used.

FIG. 21 is a graph illustrating speed variations of the first roller 152 checked when the axial center of the driven side coupling member 41 is shifted from the center of the rotation shaft of the drive side coupling member 82 by a predetermined amount and coupled to the drive side coupling member 82, using the drive connecting member 90 according to the present embodiment with the first projections 94 and the second projections 95 having cylindrical shapes. As illustrated in FIG. 21, the graph indicates that the speed variation of the first roller 152 is sufficiently restrained when compared with a configuration in which the projections of the comparative drive connecting member 190 having hemisphere shapes.

Figure 22:
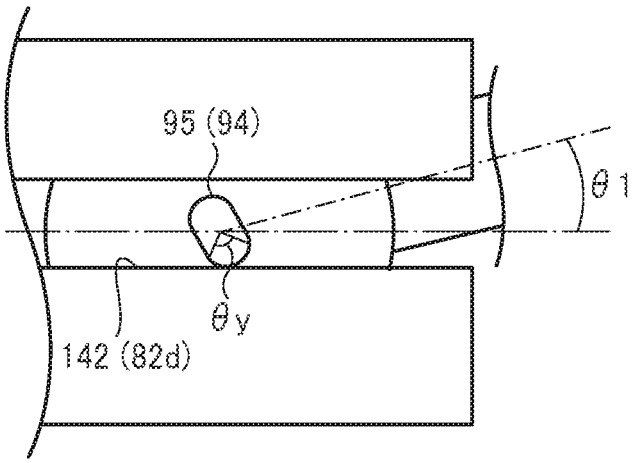
FIG. 22 is a diagram illustrating a variation of the first projection and the second projection.

Further, the first projections 94 and the second projections 95 may have any shape as long as the groove contact portion that contacts the side surface of at least the groove portion (i.e., the driven side grooves 142 and the drive side groove 82*d* (i.e., the drive side grooves 82*d*1 and 82*d*2)) extends straight (linearly) in the radial direction and protrudes in the rotation direction. Therefore, for example, the first projections 94 and the second projections 95 may have a columnar shape having a rectangular shape with rounded corners in cross section, or a columnar shape having an elliptical shape in cross section, as illustrated in FIG. 22.

Further, in a case in which the groove contact portion of the projection (i.e., the first projections 94 and the second projections 95), which contacts the side surface of the groove portion (i.e., the driven side grooves 142 and the drive side grooves 82*d*1 and 82*d*2), has an arc surface, a center angle θy of the arc is set to be twice or more the maximum inclination angle θ1 of the drive connecting member 90 in the direction perpendicular to the protruding direction of the projection (i.e., the first projections 94 and the second projections 95) of the drive connecting member 90. According to this configuration, even when the drive connecting member 90 is inclined at the maximum inclination angle θ1, the arc surface of the projection (i.e., the first projections 94 and the second projections 95) is brought to contact the side surface of the groove portion (i.e., the driven side grooves 142 and the drive side grooves 82*d*1 and 82*d*2). Accordingly, even when the drive connecting member 90 is inclined at the maximum inclination angle θ1, the contact between the groove portion (i.e., the driven side grooves 142 and the drive side grooves 82*d*1 and 82*d*2) and the projection (i.e., the first projections 94 and the second projections 95) as viewed from the protruding direction of the projection is the point connection, and the drive connecting member 90 is smoothly inclined.

Figure 23:
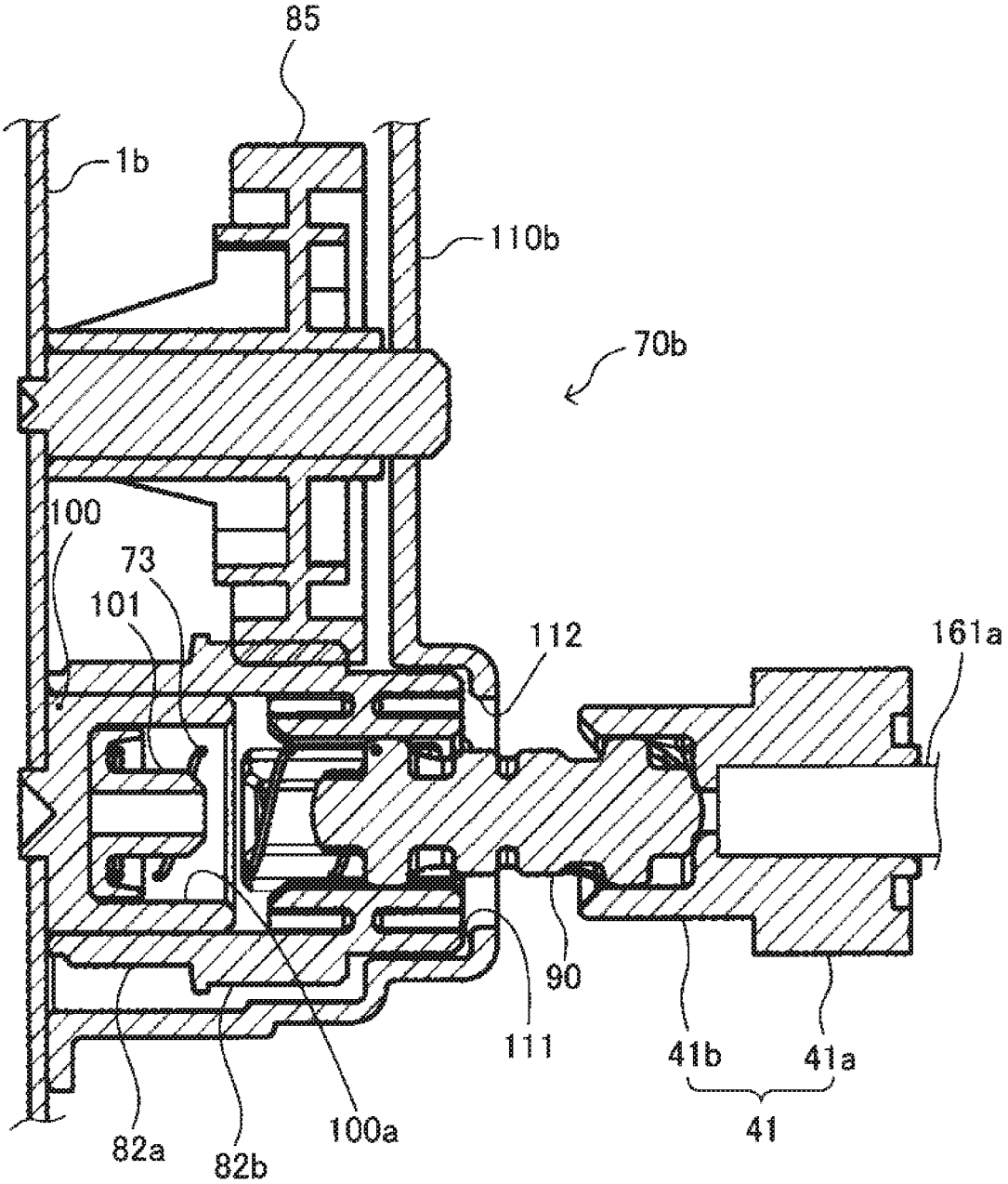
FIG. 23 is a schematic cross-sectional view illustrating a second drive transmission portion.

FIG. 23 is a schematic cross-sectional view illustrating the second drive transmitting portion 70*b*.

As illustrated in FIG. 23, the second drive transmitting portion 70*b* basically has a configuration identical to the first drive transmitting portion 70*a*, except that the second drive transmitting portion 70*b* employs gears for drive transmission to the drive side coupling member 82 while the first drive transmitting portion 70*a* employs the timing belt 81. The drive side coupling member 82 is rotatably supported by the metal stud 100 having the cylindrical shape, inside which the spring holder 101 and the coil spring 73 are contained. Further, the drive connecting member 90 assembled to the drive side coupling member 82 is biased toward the unit side by the coil spring 73.

The gear 82*b* of the drive side coupling member 82 preferably has helical teeth generating a thrust force on the drive side coupling member 82 toward the side plate side during drive transmission. By providing the gear 82*b* having the helical teeth, the drive side coupling member 82 is prevented from moving in a direction to come out from the metal stud 100 during the drive transmission.

In the present embodiment, the opening 82*c* of the drive side coupling member 82 functions as a through hole, so that the drive connecting member 90 is inserted through one end of the opening 82*c* and the metal stud 100 is inserted through the other end of the opening 82*c*. However, the configuration of the drive side coupling member 82 is not limited to this configuration. For example, the drive side coupling member 82 may have one opening through which the drive connecting member 90 is inserted and another opening through which the metal stud 100 is inserted.

Further, in the present embodiment, the first roller 152 of the first unit 150 and the second roller 162 of the second unit 160 are driven by a single drive motor, i.e., the drive motor 80. However, the configuration of the drive transmitting device 70 is not limited to this configuration. For example, the drive transmitting device 70 may include one drive motor to drive and rotate the first roller 152 of the first unit 150 and another drive motor to drive and rotate the second roller 162 of the second unit 160.

Further, in the present embodiment, the driven side coupling member 41 is rotatably attached to the metal stud 100 of the unit. However, the configuration of the driven side coupling member 41 is not limited to this configuration. For example, the driven side coupling member 41 may be attached to a rotary shaft of a roller of a unit such that the driven side coupling member 41 rotates with the rotary shaft.

The configurations according to the above-described embodiments are not limited thereto. This disclosure can achieve the following aspects effectively.

Aspect 1.

In Aspect 1, a drive transmitting device (for example, the drive transmitting device 70) includes a support (for example, the metal stud 100), a first rotary body (for example, the drive side coupling member 82), a second rotary body (for example, the driven side coupling member 41), and a connector (for example, the drive connecting member 90). The first rotary body is rotatably supported by the support and includes a support receiving portion (for example, the opening 82*c*) with an opening (for example, the opening 82*c*) disposed at a center of rotation of the first rotary body. The second rotary body has an opening at a center of rotation of the second rotary body. The connector has one end inserted into the opening of the support receiving portion of the first rotary body and another end inserted into the opening of the second rotary body in an axial direction of the connector. The connector connects the first rotary body and the second rotary body. The support is inserted into the opening of the support receiving portion of the first rotary body.

In the configuration of the known drive transmitting device in which the first rotary body is inserted into the opening of the supporting member to support the first rotary body, the supporting member is made of resin material. With this configuration of the known drive transmitting device, in a case in which the belt is used to transmit a driving force to the first rotary body and an excessive radial load is applied to the supporting member from the first rotary body, it was likely that the supporting member was welded due to friction with the first rotary body. To address this inconvenience, the supporting member may be made of metal. However, in the configuration in which the first rotary body is inserted into the opening of the supporting member to support the first rotary body, the diameter of the supporting member may need to be increased. Accordingly, in a case in which the supporting member made of metal is employed, the part cost increases.

Further, in the configuration in which the first rotary body is inserted into the opening of the supporting member to support the first rotary body, the first rotary body may be inserted up to a range before the gear portion that is formed on the outer circumferential surface of the rotary body. In other words, the support member cannot support the first rotary body from the range of the gear portion and beyond. In the drive transmission by the gear, the force applied to the gear portion of the first rotary body is the driving force of a drive motor applied in the rotation direction of the first rotating body, and most of the driving force can be turned aside as the first rotary body rotates. However, when a belt is used for drive transmission to the first rotary body, a tension force of the belt is added to the pulley of the first rotary body that stretches the belt with tension. The tension force of the belt cannot be turned aside as the first rotary body rotates. As a result, it is likely that the tension force of the belt applied to the pulley causes the first rotary body to tilt with the portion of the supporting member as a fulcrum.

Therefore, in Aspect 1, the support such as the metal stud 100 is inserted into the support receiving portion of the first rotary body such as the drive side coupling member 82 to support the first rotary body. According to this configuration, an increase in the diameter of the support is restrained and, even when the support is made of metal, an increase in cost of the device is restrained. As a result, the increase in cost of the device is restrained, and therefore the support is prevented from being weld. Further, in the axial direction, the support can be inserted to a portion where the drive transmission portion of the first rotary body is formed, and therefore can support the portion where the drive transmission portion is formed. According to this configuration, the portion where the drive transmitting portion is formed is supported by the support. Therefore, even if the drive transmitting portion of the first rotary body is the pulley that stretches the belt, the support surely receives the tension force of the belt to be applied to the pulley, and therefore the first rotary body is restrained from inclining.

Aspect 2.

In Aspect 1, the drive transmitting device (for example, the drive transmitting device 70) further includes a belt (for example, the timing belt 81). The first rotary body (for example, the drive side coupling member 82) includes a tensioning portion (for example, the pulley 82*a*) to tension the belt. The support (for example, the metal stud 100) is axially inserted into the support receiving portion (for example, the opening 82*c*) to or beyond a range including the tensioning portion.

According to this configuration, as described in the embodiments above, the tension force of the belt to be applied to the tensioning portion is received by the support. Therefore, the first rotary body is supported stably.

Aspect 3.

In Aspect 2, the first rotary body (for example, the drive side coupling member 82) includes a gear (for example, the gear 82*b*) that is disposed at a position closer to the second rotary body (for example, the driven side coupling member 41) in an axial direction of the first rotary body than the tensioning portion (for example, the pulley 82*a*) is.

According to this configuration, as described in the embodiments above, even either one of the belt (for example, the timing belt 81) and the gear is used for drive transmission to the first rotary body (for example, the drive side coupling member 82), the first rotary body having the same configuration is applied to this disclosure, and therefore a reduction in the parts management cost can be achieved.

Further, by providing the gear closer to the second rotary body than the tension body, when compared with the configuration in which the tension body is provided closer to the second rotary body than the gear, the size of the drive transmitting device can be reduced in the axial direction.

Aspect 4.

In Aspect 3, the gear (for example, the gear 82*b*) has helical teeth.

According to this configuration, when transmitting a driving force, the first rotary body (for example, the drive side coupling member 82) generates a thrust force in a direction to insert the support (for example, the metal stud 100), and therefore the first rotary body is restrained from coming off from the support.

Aspect 5.

In any one of Aspects 1 through 4, the drive transmitting device (for example, the drive transmitting device 70) further includes a biasing body (for example, the coil spring 73) disposed in the opening of the first rotary body to bias the connector toward the second rotary body (for example, the driven side coupling member 41) in the axial direction of the connector. The connector (for example, the drive connecting member 90) is movably attached to the first rotary body in the axial direction of the connector. The support includes a storing portion (for example, the spring storing portion 100*a*) to store at least part of the biasing body.

According to this configuration, as described in the embodiments above, when compared with the configuration in which the support does not include the storing portion, the drive transmitting device can be reduced in size in the axial direction.

Aspect 6.

In Aspect 5, the support (for example, the metal stud 100) and the biasing body (for example, the coil spring 73) are made of metal. The storing portion (for example, the spring storing portion 100*a*) is provided with a resin receiver (for example, the spring holder 101) to receive the biasing body.

According to this configuration, as described in the embodiments above, the biasing body that is made of metal is received by the resin receiver. Therefore, when the biasing body is rotated together with the connector (for example, the drive connecting member 90), the biasing body is restrained from generating the sliding sound.

Aspect 7.

In Aspect 6, the resin receiver for example, the spring holder 101) is made of a conductive resin.

According to this embodiment, as described in the embodiments as described in the embodiments above, static electricity generated due to the sliding between the connector (for example, the drive connecting member 90) and the first rotary body (for example, the drive side coupling member 82) or the sliding between the connector and the second rotary body (for example, the driven side coupling member 41) can be released via the biasing body (for example, the coil spring 73), the resin receiver, and the support (for example, the metal stud 100).

Aspect 8.

In any one of Aspects 6 through 7, the connecting body (for example, the drive connecting member 90) includes biasing body receiving portions (for example, the first spring holder 96*a* and the second spring holder 96*b*) at both ends in the axial direction of the connector to receive the biasing body.

According to this configuration, as described in the embodiments above, one end or the other end of the connector is inserted into the opening (for example, the opening 82*c*) of the support receiving portion of the first rotary body (for example, the drive side coupling member 82).

Aspect 9.

In any one of Aspects 1 through 8, the connector (for example, the drive connecting member 90) includes projections (for example, the first projections 94 and the second projections 95) radially projecting at both ends in the axial direction of the connector. The projections include a first projection at the one end of the connector and a second projection at said another end of the connector in the axial direction of the connector. The first projection and the second projection are disposed at different positions from each other by an angle in a rotation direction of the connector.

According to this configuration, as described in the embodiments above, the projections mounted at both ends of the connector are prevented from entering the grooves, and the connector is prevented from coming out from the first rotary body.

Accordingly, it is restrained that the connector comes out from the first rotary body and that the connector is assembled to the first rotary body again. Therefore, the connector is assembled to the first rotary body easily.

Aspect 10.

In Aspect 9, the first rotary body (for example, the drive side coupling member 82) includes, on the inner circumferential surface of the opening (for example, the opening 82*c*), a drive side groove (for example, the drive side grooves 82*d*1 and 82*d*2) having a retaining portion (for example, the retaining portions 82*h*) to prevent the first projection and the second projection (for example, the first projections 94 and the second projections 95) from coming out from the support, a guide groove (for example, the guide grooves 82*e*1 and 82*e*2) to guide the first projection and the second projection in the axial direction of the connector, and a communication portion (for example, the communication portion 82*i*) to communicate the drive side groove and the guide groove. When the first projection is located in the drive side groove, the second projection and the guide groove are located at different positions from each other in the rotation direction of the connector.

According to this configuration, as described in the embodiments above, when the projections (for example, the first projections 94 and the second projections 95) at one end of the connector is positioned at the drive side groove of the first rotary body, said another projection at the other end of the connector is prevented from entering the guide groove. Accordingly, the first rotary body is prevented from coming out from the first rotary body, and the first rotary body assembled to the connector is assembled to the support (for example, the metal stud 100) easily.

Aspect 11.

In any one of Aspects 1 through 10, the drive transmitting device (for example, the drive transmitting device 70) further includes a cover (for example, the first cover 110*a*) to cover the first rotary body and a drive transmitting body (for example, the timing belt 81) to transmit a driving force from a drive source (for example, the drive motor 80) to the first rotary body (for example, the drive side coupling member 82). The cover includes a retaining portion (for example, the retaining portion 111) configured to prevent the first rotary body from coming out from the support (for example, the metal stud 100).

According to this configuration, as described in the embodiments above, the first rotary body is prevented from coming out from the support. In addition, when compared with a configuration in which the cover and the retaining portion that prevents the first rotary body from coming out from the support are provided separately, the number of parts is reduced, and therefore a reduction in cost of the image drive transmitting device can be achieved.

Aspect 12.

In any one of Aspects 1 through 11, the connector (for example, the drive connecting member 90) includes projections (for example, the first projections 94 and the second projections 95) radially projecting at both ends in the axial direction of the connector. Each of the first rotary body and the second rotary body includes, on an inner circumferential surface of the opening, grooves (for example, the drive side grooves 82*d*1 and 82*d*2, the guide grooves 82*e*1 and 82*e*2, the driven side grooves 142) along which the projections move in the axial direction of the connector. Each of the projections has a contact portion to contact a corresponding one of the grooves and the contact portion has an arc shape when the projections are viewed from a projecting direction of the projections.

According to this configuration, as described with reference to FIGS. 16 to 21, the speed variation checked when the axis misalignment is generated between the first rotary body and the second rotary body (for example, the driven side coupling member 41) is restrained more when compared with the configuration in which the projections have a spherical shape.

Aspect 13.

In any one of Aspects 1 through 12, the connector (for example, drive connecting member 90) is made of a resin and includes an inserting portion (for example, the first spherical portion 91 and the second spherical portion 92), and where an axial direction of the connector is represented as an X-direction, a specific direction perpendicular to the X-direction is represented as a Y-direction, and a direction perpendicular to both the X-direction and the Y-direction is represented as a Z-direction, the inserting portion has a spherical shape that is lightened, leaving a first large circle (for example, the first drive side large circle 91*a* and the first driven side large circle 92*a*) extending perpendicular to the X-direction, a second large circle (for example, the second drive side large circle 91*b* and the second driven side large circle 92*b*) extending perpendicular to the Y-direction, and a third large circle (for example, the third drive side large circle 91*c* and the third driven side large circle 92*c*) extending perpendicular to the Z-direction.

According to this configuration, as described with reference to FIG. 7, sink marks of the respective portions are restrained, and each insertion portion can be molded with high accuracy. Further, even if the connecting portion (for example, the connecting portion 93) of the connector is long, each of the inserting portions can be evenly lightened. Accordingly, even if the connecting portion of the connector is long, sink marks of the respective inserting portions can be preferably restrained, and each inserting portion can be formed with high accuracy. In addition, the diameter of the connector can be reduced, and the connector can be reduced in size.

Further, the connector is smoothly inclined relative to the first rotary body and the second rotary body.

Aspect 14.

In Aspect 14, an image forming apparatus (for example, the image forming apparatus 1000) includes the drive transmitting device (for example, the drive transmitting device 70) according to Aspects 1 through 13 to transmit a driving force from a drive source (for example, the drive motor 80).

According to this configuration, the angular speed variation of the first roller to be transmitted by the drive transmitting device can be restrained, and therefore a preferable image is formed.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A drive transmitting device comprising:

a support;

a first rotary body rotatably supported by the support and including a support receiving portion with an opening disposed at a center of rotation of the first rotary body, the support being inserted into the opening of the support receiving portion of the first rotary body;

a second rotary body having an opening at a center of rotation of the second rotary body;

a connector having one end inserted into the opening of the support receiving portion of the first rotary body and another end inserted into the opening of the second rotary body in an axial direction of the connector, the connector connecting the first rotary body and the second rotary body; and a belt, the first rotary body including a tensioning portion to tension the belt, and wherein the support is axially inserted into the support receiving portion to or beyond a range including the tensioning portion.

2. The drive transmitting device according to claim 1, wherein the first rotary body includes a gear that is disposed at a position closer to the second rotary body in an axial direction of the first rotary body than the tensioning portion is.

3. The drive transmitting device according to claim 2, wherein the gear has helical teeth.

4. The drive transmitting device according to claim 1, further comprising a biasing body disposed in the opening of the first rotary body to bias the connector toward the second rotary body in the axial direction of the connector, wherein the connector is movably attached to the first rotary body in the axial direction of the connector, and wherein the support includes a storing portion to store at least part of the biasing body.

5. The drive transmitting device according to claim 4, wherein the support and the biasing body are made of metal, and wherein the storing portion is provided with a resin receiver to receive the biasing body.

6. The drive transmitting device according to claim 5, wherein the resin receiver is made of a conductive resin.

7. The drive transmitting device according to claim 4, wherein the connector includes biasing body receiving portions at both ends in the axial direction of the connector to receive the biasing body.

8. A drive transmitting device comprising:

a support;

a first rotary body rotatably supported by the support and including a support receiving portion with an opening disposed at a center of rotation of the first rotary body, the support being inserted into the opening of the support receiving portion of the first rotary body;

a second rotary body having an opening at a center of rotation of the second rotary body; and a connector having one end inserted into the opening of the support receiving portion of the first rotary body and another end inserted into the opening of the second rotary body in an axial direction of the connector, the connector connecting the first rotary body and the second rotary body, wherein the connector includes projections radially projecting at both ends in the axial direction of the connector, wherein the projections include a first projection at the one end of the connector and a second projection at said another end of the connector in the axial direction of the connector, wherein the first projection and the second projection are disposed at different positions from each other by an angle in a rotation direction of the connector, wherein the first rotary body includes, on an inner circumferential surface of the opening:

a drive side groove having a retaining portion to prevent the first projection and the second projection from coming out from the support;

a guide groove to guide the first projection and the second projection in the axial direction of the connector; and a communication portion to communicate the drive side groove and the guide groove, and wherein, when the first projection is located in the drive side groove, the second projection and the guide groove are located at different positions from each other in the rotation direction of the connector.

9. The drive transmitting device according to claim 1, further comprising a cover to cover the first rotary body and a drive transmitting body to transmit a driving force from a drive source to the first rotary body, and wherein the cover includes a retaining portion to prevent the first rotary body from coming out from the support.

10. An image forming apparatus comprising the drive transmitting device according to claim 1 to transmit a driving force from a drive source.

11. An image forming apparatus comprising the drive transmitting device according to claim 8 to transmit a driving force from a drive source.

12. The drive transmitting device according to claim 8, further comprising a cover to cover the first rotary body and a drive transmitting body to transmit a driving force from a drive source to the first rotary body, and wherein the cover includes a retaining portion to prevent the first rotary body from coming out from the support.

13. The drive transmitting device according to claim 8, further comprising a belt, wherein the first rotary body includes a tensioning portion to tension the belt, and wherein the support is axially inserted into the support receiving portion to or beyond a range including the tensioning portion.

14. The drive transmitting device according to claim 13, wherein the first rotary body includes a gear that is disposed at a position closer to the second rotary body in an axial direction of the first rotary body than the tensioning portion is.

15. The drive transmitting device according to claim 1, wherein the connector includes projections radially projecting at both ends in the axial direction of the connector, wherein the projections include a first projection at the one end of the connector and a second projection at said another end of the connector in the axial direction of the connector, and wherein the first projection and the second projection are disposed at different positions from each other by an angle in a rotation direction of the connector.

* * * * *